US007120374B2

(12) United States Patent
Karakama et al.

(10) Patent No.: US 7,120,374 B2
(45) Date of Patent: Oct. 10, 2006

(54) PROCESS CARTRIDGE AND ELECTROPHOTOGRAPHIC IMAGE-FORMING APPARATUS

(75) Inventors: Toshiyuki Karakama, Tokyo (JP); Noriyuki Komatsu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/844,768

(22) Filed: May 12, 2004

(65) Prior Publication Data

US 2004/0234293 A1 Nov. 25, 2004

(30) Foreign Application Priority Data

May 20, 2003 (JP) ..... 2003-141596
Apr. 23, 2004 (JP) ..... 2004-128539

(51) Int. Cl.
*G03G 21/18* (2006.01)

(52) U.S. Cl. ..... 399/111

(58) Field of Classification Search ..... 399/111, 399/12, 13, 114
See application file for complete search history.

(56) References Cited

U.S. PATENT DOCUMENTS

| | | | | |
|---|---|---|---|---|
| 5,911,096 | A | 6/1999 | Batori et al. | |
| 5,966,567 | A | 10/1999 | Matsuzaki et al. | |
| 6,154,623 | A | 11/2000 | Suzuki | |
| 6,317,572 | B1 * | 11/2001 | Miyabe et al. | 399/111 |
| 6,647,226 | B1 * | 11/2003 | Katakabe et al. | 399/108 |
| 6,738,589 | B1 * | 5/2004 | Karakama et al. | 399/111 |
| 2002/0131792 | A1 * | 9/2002 | Nomura | |

FOREIGN PATENT DOCUMENTS

| | | | |
|---|---|---|---|
| JP | 07-271274 | | 10/1995 |
| JP | 07-271274 | A | 10/1995 |
| JP | 08-133293 | A | 5/1996 |
| JP | 08-339147 | | 12/1996 |
| JP | 10-171329 | | 6/1998 |
| JP | 10-228222 | | 8/1998 |
| JP | 2000-221746 | | 8/2000 |
| JP | 2002-196650 | A | 7/2002 |
| JP | 2002-328586 | | 11/2002 |
| JP | 2002-333813 | | 11/2002 |
| JP | 2003-131455 | | 5/2003 |

* cited by examiner

*Primary Examiner*—David M. Gray
*Assistant Examiner*—Laura K Roth
(74) *Attorney, Agent, or Firm*—Canon U.S.A. Inc. I.P. Div

(57) ABSTRACT

A process cartridge to be detachably attached to an electrophotographic image-forming apparatus body includes a cartridge frame; an electrophotographic photosensitive drum; a processing unit for acting on the electrophotographic photosensitive drum; a handle for gripping the process cartridge when the process cartridge is mounted on a first electrophotographic image-forming apparatus body; and an mounting unit provided in the cartridge frame, to which a handle member is attached for gripping the process cartridge when the process cartridge is mounted on a second electrophotographic image-forming apparatus body in a case where the second electrophotographic image-forming apparatus body is used on which the process cartridge is mounted in a direction different from that of the first electrophotographic image-forming apparatus. Thereby, by achieving commonality of the cartridge-frame structure, the system can corresponds to the first electrophotographic image-forming apparatus and the second electrophotographic image-forming apparatus.

7 Claims, 19 Drawing Sheets

PROCESS CARTRIDGE AND ELECTROPHOTOGRAPHIC IMAGE-FORMING APPARATUS

BACKGROUND OF THE INVENTION

1. Field of the Invention

The present invention relates to a process cartridge able to be mounted on and dismounted off an electrophotographic image-forming apparatus body and an electrophotographic image-forming apparatus capable of mounting or dismounting the process cartridge.

2. Description of Related Art

Wherein the electrophotographic image-forming apparatus means an apparatus for forming an image on a recording medium using an electrophotographic image-forming process. Examples of the electrophotographic image-forming apparatus include an electrophotographic copying machine, an electrophotographic printer (a laser-beam printer and an LED printer, for example), a facsimile machine, and a word processor.

The process cartridge means a cartridge integrated with a charging means as process means, developing means or cleaning means, and an electrophotographic sensitive member to be mounted on and dismounted off the electrophotographic image-forming apparatus body. Furthermore, the process cartridge means a cartridge integrated with at least one of charging means as process means, developing means, and cleaning means; and the electrophotographic sensitive member to be mounted on and dismounted off the electrophotographic image-forming apparatus body. The process cartridge also means a cartridge integrated at least with charging means as process means and the electrophotographic sensitive member to be mounted on and dismounted off the electrophotographic image-forming apparatus body.

In an electrophotographic image-forming apparatus using an electrophotographic image-forming process, a process cartridge system has been adopted in that a cartridge integrated with an electrophotographic sensitive member and processing means for acting on the processing unit is mounted on and dismounted off an electrophotographic image-forming apparatus body.

According to this process cartridge system, since the maintenance of the apparatus can be done by a user oneself without depending on a service personnel, operationality has been largely improved. Therefore, the cartridge system has been widely used in the electrophotographic image-forming apparatus.

For example, the process cartridge is mounted on or dismounted off the apparatus body by a user oneself. Thus, in order to improve the operationality when the process cartridge is mounted on the apparatus body, the process cartridge may be provided with a handle member attached to upward protrude from the process cartridge frame (see Japanese Patent Laid-Open No. 7-271274). Also, a toner container may be provided with handles arranged on entire regions in the axial direction of an electrophotographic sensitive member, and an operator may grip this handle (see U.S. Pat. No. 6,154,623).

SUMMARY OF THE INVENTION

It is an object of the present invention to use a cartridge frame both for a process cartridge used in a first electrophotographic image-forming apparatus and for a second process cartridge used in a second electrophotographic image-forming apparatus, on which the second process cartridge is mounted in a direction different from that of the first electrophotographic image-forming apparatus.

It is an object of the present invention to provide a process cartridge wherein a gripped portion can be substantially identically positioned even when the process cartridge is mounted on an electrophotographic image-forming apparatus from a different direction, and an electrophotographic image-forming apparatus on which the process cartridge can be detachably mounted.

It is another object of the present invention to provide a process cartridge capable of reducing cost by achieving commonality of a cartridge frame of the process cartridge, and an electrophotographic image-forming apparatus on which the process cartridge can be detachably mounted.

It is another object of the present invention to provide a process cartridge capable of improving the operationality in mounting and dismounting the process cartridge on an electrophotographic image-forming apparatus on which the process cartridge is mounted from a different direction by attaching a handle member, and an electrophotographic image-forming apparatus on which the process cartridge can be detachably mounted.

It is another object of the present invention to provide a process cartridge to be detachably attached to the body of an electrophotographic image-forming apparatus including (i) an electrophotographic photosensitive drum; (ii) processing means for acting on the electrophotographic photosensitive drum; and (iii) a cartridge frame including a gripper portion for gripping the process cartridge when the process cartridge is mounted on the electrophotographic image-forming apparatus and a mounting portion for mounting a handle member for gripping a second process cartridge when the second process cartridge is mounted on the body of a second electrophotographic image-forming apparatus in a case where the body of the second electrophotographic image-forming apparatus is used, on which the second process cartridge is mounted in a direction different from that of the electrophotographic image-forming apparatus.

It is another object of the present invention to provide an electrophotographic image-forming apparatus for forming an image on a recording medium detachably having a process cartridge, the apparatus including (i) mounting means for detachably mounting the process cartridge; (ii) the process cartridge mounted on the mounting means including an electrophotographic photosensitive drum, processing means for acting on the electrophotographic photosensitive drum, and a cartridge frame including a gripper portion for gripping the process cartridge when the process cartridge is mounted on the body of the electrophotographic image-forming apparatus and a mounting portion for mounting a handle member for gripping a second process cartridge when the second process cartridge is mounted on the body of a second electrophotographic image-forming apparatus in a case where the body of the second electrophotographic image-forming apparatus is used, on which the second process cartridge is mounted in a direction different from that of the electrophotographic image-forming apparatus; and (iii) conveying means for conveying the recording medium.

It is another object of the present invention to provide an assembling method of a process cartridge including the steps of using the process cartridge including an electrophotographic photosensitive drum, processing means for acting on the electrophotographic photosensitive drum, and a gripper portion formed in a cartridge frame for gripping the process cartridge when the process cartridge is mounted on the body of an electrophotographic image-forming apparatus; and attaching a handle member formed separately from the cartridge frame to the cartridge frame in a case where a second process cartridge is assembled, which is mounted on the body of a second electrophotographic image-forming apparatus on which the second process cartridge is mounted in a direction different from that of the electrophotographic image-forming apparatus.

Further objects, features and advantages of the present invention will become apparent from the following description of the preferred embodiments with reference to the attached drawings.

DESCRIPTION OF THE PREFERRED EMBODIMENTS

A preferred embodiment according to the present invention will be exemplifiably described below in detail with reference to the drawings. However, the scope of the invention is not limited to sizes, materials, shapes, and their relative arrangements of components described in this embodiment unless there is a specific description. Also, in the description below, materials and shapes of the members once described are the same as those firstly described unless there is a specific description on another occasion.

(Overall Structure of First Image-forming Apparatus)

Figure 1:
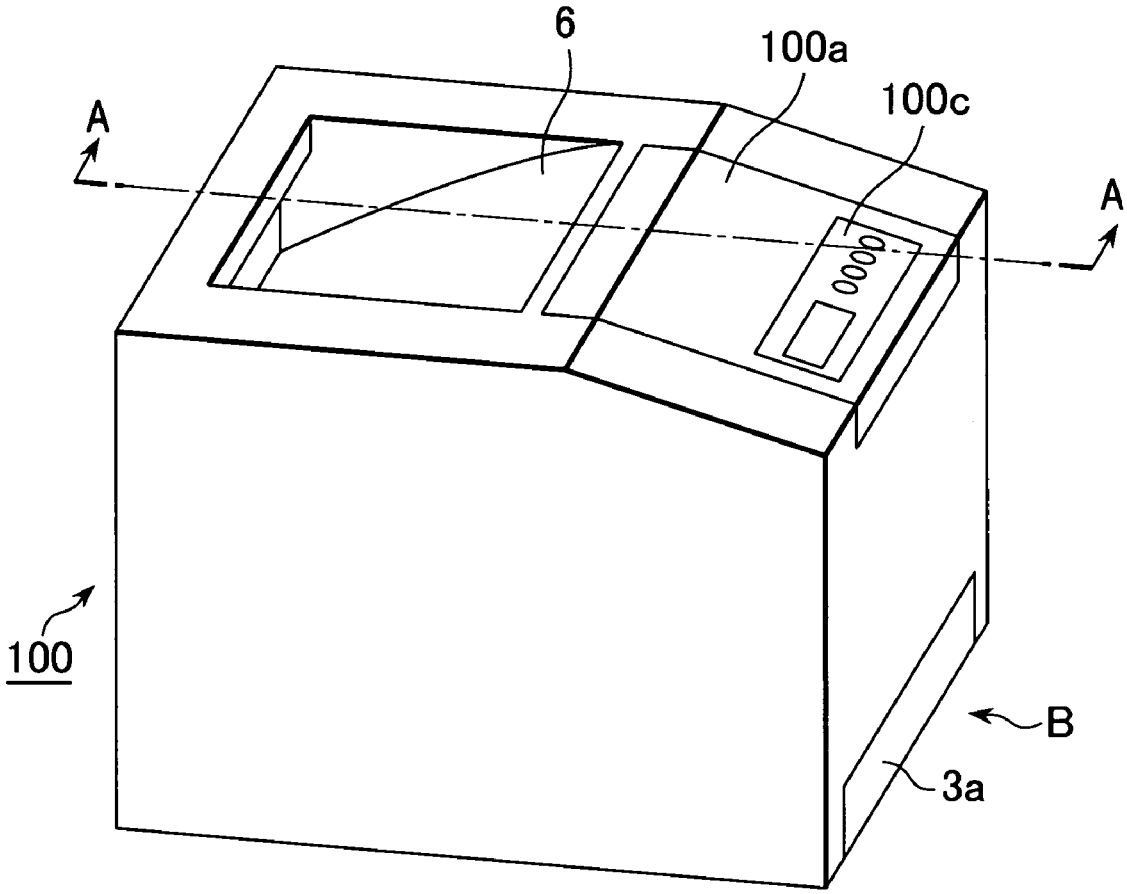
FIG. 1 is an external perspective view of a first image-forming apparatus according to an embodiment.
Figure 2:
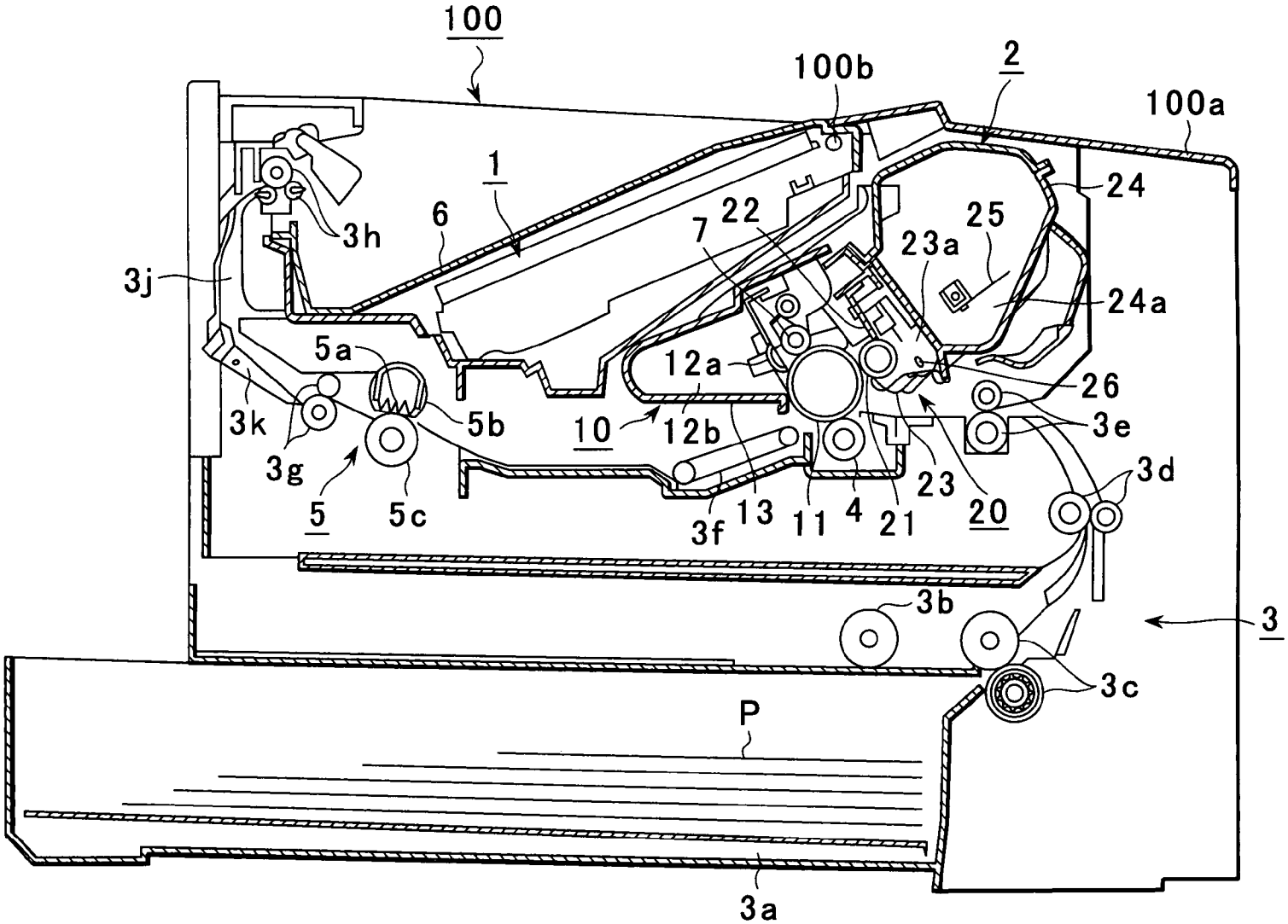
FIG. 2 is a longitudinal sectional view of the first image-forming apparatus according to the embodiment.

FIG. 1 is an external perspective view of a first image-forming apparatus on which a process cartridge according to the embodiment can be mounted. FIG. 2 is a sectional view of the first image-forming apparatus according to the embodiment at the line A—A of FIG. 1.

A first image-forming apparatus (referred to as a first apparatus below) 100 includes an optical unit 1 having a laser diode, a polygon mirror, a lens, and a reflection mirror. By applying a laser beam corresponding to image information obtained from the optical unit 1, a latent image corresponding to the image information is formed on an electrophotographic photosensitive drum 11 of a first process cartridge 2. This latent image is developed by a developing unit so as to be a visible image, i.e., a toner image.

A second process cartridge 202 includes a developing frame 223 as a cartridge frame, a drum frame 213, and a toner container 224. The developing unit, which is one of processing units for image-forming, includes a developing roller 21 as a developer carrier and a developing blade 22 for restricting the amount of developer adhering on the surface of the developing roller 21. Also, a developing frame 23 retaining the developing roller 21 and the developing blade 22 and a toner container 24 having a toner storage 24*a* containing developer constitute a developing unit 20 as a developing device.

The developing frame 23 includes a developing chamber 23*a*, and toner contained in the toner storage 24*a* disposed adjacent to the developing chamber 23*a* is fed to the developing roller 21 in the developing chamber 23*a* by the rotation of a toner feeding member 25. The developing frame 23 is equipped with a rotary toner agitating member 26 disposed in the vicinity of the developing roller 21 for circulating the toner in the developing chamber 23*a* fed from the toner storage 24*a*. The toner has the magnetism while the developing roller 21 has a fixed magnet built therein so that the toner adheres on the developing roller 21.

Then, by rotating the developing roller 21, the toner is conveyed and charged by frictional electrification in the developing blade 22. Furthermore, a toner layer is formed in a predetermined thickness on the developing roller 21, and conveyed to a developing region on the photosensitive drum 11. The toner supplied to the developing region is transferred to the latent image on the photosensitive drum 11, thereby forming a toner image on the photosensitive drum 11. The developing roller 21 is connected to a developing bias circuit provided on the body of the image-forming apparatus, so that a developing bias voltage, which is an AC voltage superimposed by a DC voltage, is generally applied thereon.

On the other hand, a feeding unit 3 conveys a recording medium P arranged within a feeding cassette 3*a* mounted in the body of the first apparatus 100 from arrow B direction of FIG. 1 to a transfer position via a pick-up roller 3*b*, conveying roller pairs 3*c*, 3*d*, and 3*e* in operative association with the toner-image forming. At the transfer position, a transfer roller 4 is arranged as a transfer unit. By applying a voltage to the transfer roller 4, the toner image on the photosensitive drum 11 is transferred on the recording medium P.

The recording medium P having the toner image transferred thereon is conveyed to a fixing unit 5 by a conveying guide 3*f*. The fixing unit 5, having a drive roller 5*c* and a fixing roller 5*b* including a heater 5*a* housed therein, applies heat and pressure on the passing recording medium P so as to fix the transferred toner image on the recording medium P.

The recording medium P is conveyed by discharge roller pairs 3*g* and 3*h*, and is discharged to a discharge tray 6 via an inversion path 3*j*. The discharge tray 6 is arranged on the upper surface of the body of the image-forming apparatus 100. In addition, the recording medium P may also be discharged by operating a swingable flapper 3*k* without interposing the inversion path 3*j*. In such a manner, the pick-up roller 3*b*, the conveying roller pairs 3*c*, 3*d*, and 3*e*, the conveying guide 3*f*, and the discharge roller pairs 3*g* and 3*h* constitute the feeding unit 3.

The photosensitive drum 11 is cleaned by a cleaning unit 12 so as to remove residual toner on the photosensitive drum 11 after transferring the toner image to the recording medium P with the transfer roller 4. Then, it will serve in the next image-forming process. The cleaning unit 12 scrapes the residual toner on the photosensitive drum 11 with a cleaning blade 12*a*, arranged to abut the photosensitive drum 11, so as to be collected in a spent toner storage 12*b*.

(Structure of Process Cartridge)

Figure 3:
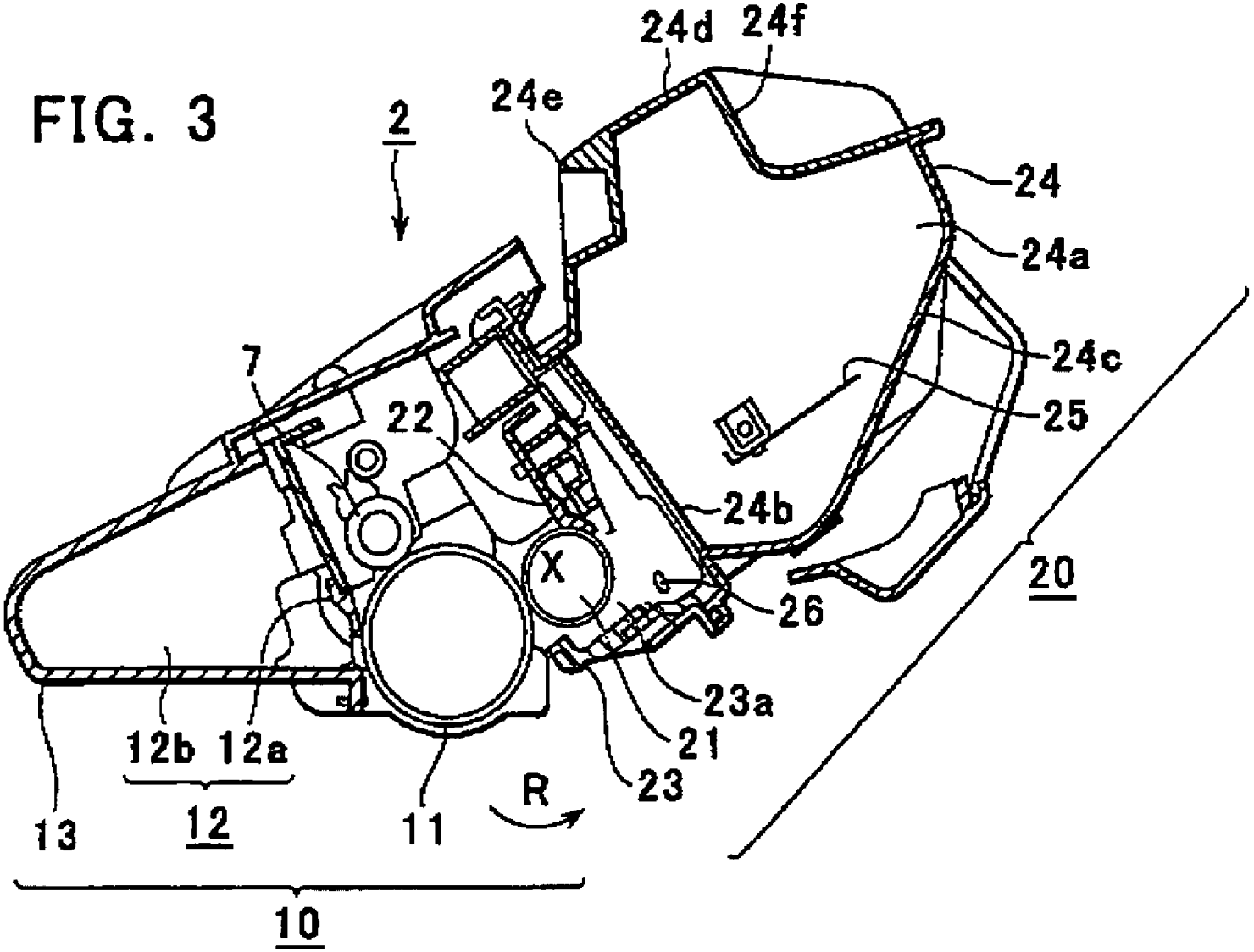
FIG. 3 is a longitudinal sectional view of a first process cartridge according to the embodiment.

FIG. 3 is a longitudinal sectional view of the first process cartridge according to the embodiment. The first process cartridge 2, including the developing frame 23 as a cartridge frame, a drum frame 13, and the toner container 24, deposits the toner container 24 on the developing frame 23 for supporting the developing roller 21 so as to integrally constitute a developing unit (developing device) 20. At this time, the toner container 24 is made by depositing a toner-container lower frame 24*c* to a toner-container upper frame 24*d*.

The toner container 24 includes a toner storage 24*a* for storing toner and a toner feeding opening 24*b* for feeding the toner contained in the toner storage 24*a* to a developing chamber 23*a*. The toner container 24 also has a toner feeding member 25 rotatably supported within the toner storage 24*a*. The toner feeding opening 24*b* is sealed with a developer seal (not shown) until the first process cartridge 2 is used. Then, upon firstly using the first process cartridge 2, toner becomes available by pulling off the developer seal by a user. Also, the developing frame 23 supports the developing roller 21 and the developing blade 22.

The drum frame 13 supports the cleaning blade 12*a*, the photosensitive drum 11, and a charging roller 7 so as to constitute a cleaning unit 10.

The first process cartridge 2 is made to form a cartridge by integrally connecting the developing unit 20 and the cleaning unit 10 together.

(Structure of Gripper Portion)

Figure 4:
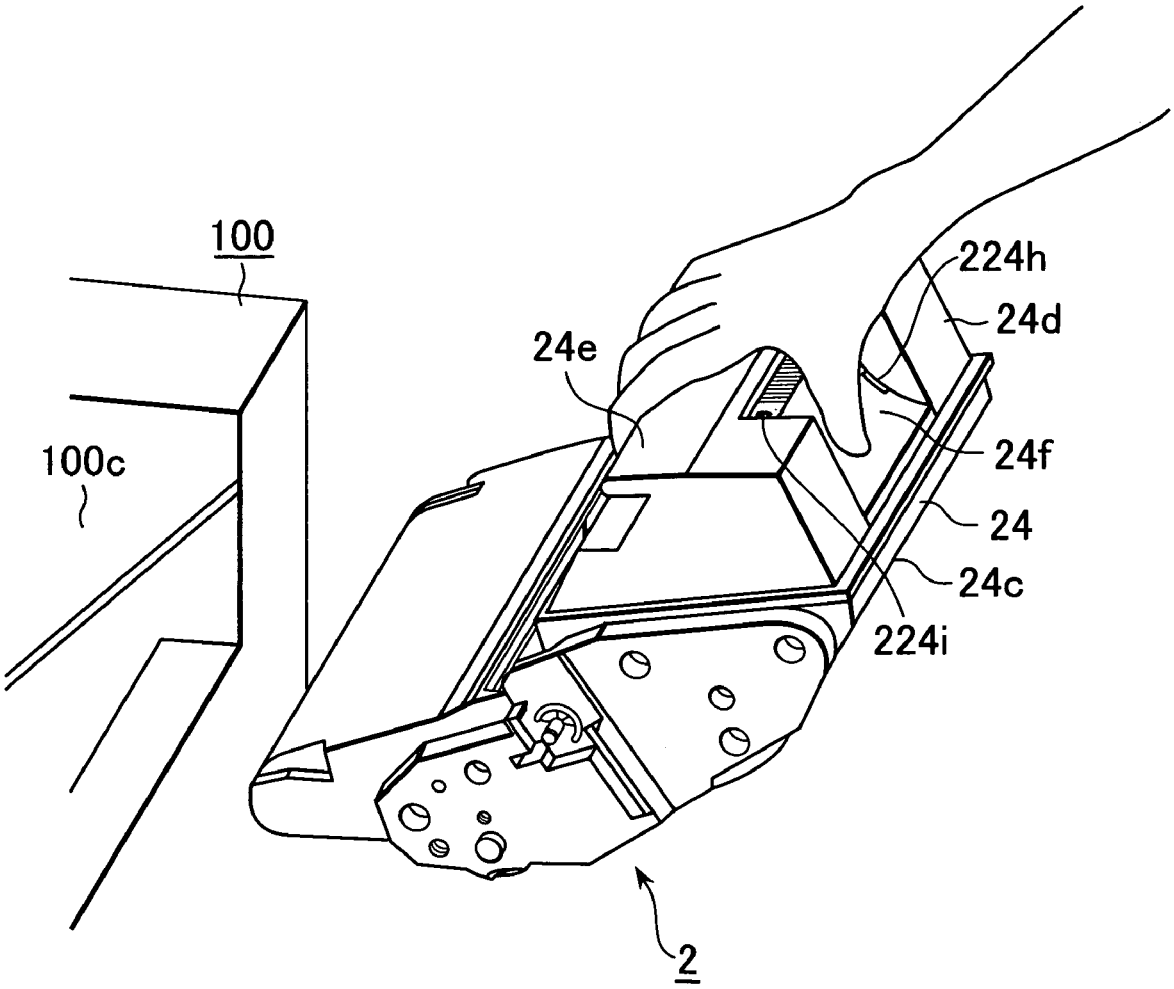
FIG. 4 is a perspective view showing a state that a user grips the first process cartridge according to the embodiment.

Next, the structure of a gripping unit will be described with reference to FIG. 4, which grips the first process cartridge 2 when the first process cartridge 2 is mounted on the body of the first apparatus 100. FIG. 4 is a perspective view showing a state that the first process cartridge 2 according to the embodiment is gripped by a user.

As shown in FIG. 4, an operator grips a gripper portion 24*e* provided in the toner container 24 so as to mount the first process cartridge 2 on the body of the first apparatus 100.

The toner-container upper frame 24*d* constituting the toner container 24 is provided with gripper portions 24*e* and 24*f*. As shown in FIG. 3, the gripper portion 24*e* has a hooked section retainable by any fingers other than a thumb. The gripper portion 24*e* is arranged to extend in the axial direction of the photosensitive drum 11. Furthermore, the first process cartridge 2 is rotated about the gripper portion 24*e* as a fulcrum in a direction that the gravity center X(as shown in FIG. 3) of the first process cartridge 2 moves to a position directly below the gripper portion 24*e* (arrow R).

Also, by pushing the gripper portion 24*f* against the rotation with a thumb, a user can grip the first process cartridge 2 easily and stably. The gripper portion 24*f* is a recess being concave from the surface of the toner-container upper frame 24*d*, and is arranged downstream from the gripper portion 24*e* in the mounting direction of the first process cartridge 2. Also, the gripper portion 24*f* is concave only substantially at the center of the photosensitive drum 11 in the axial direction. The length of the recess in the axial direction is appropriately one third of the length of the first process cartridge 2 in the axial direction.

(Structure of Mounting-guide Unit of Process Cartridge)

Next, a mounting guide unit when the first process cartridge 2 is mounted on the body of the first apparatus 100 will be described with reference to FIGS. 5 to 8.

Figure 5:
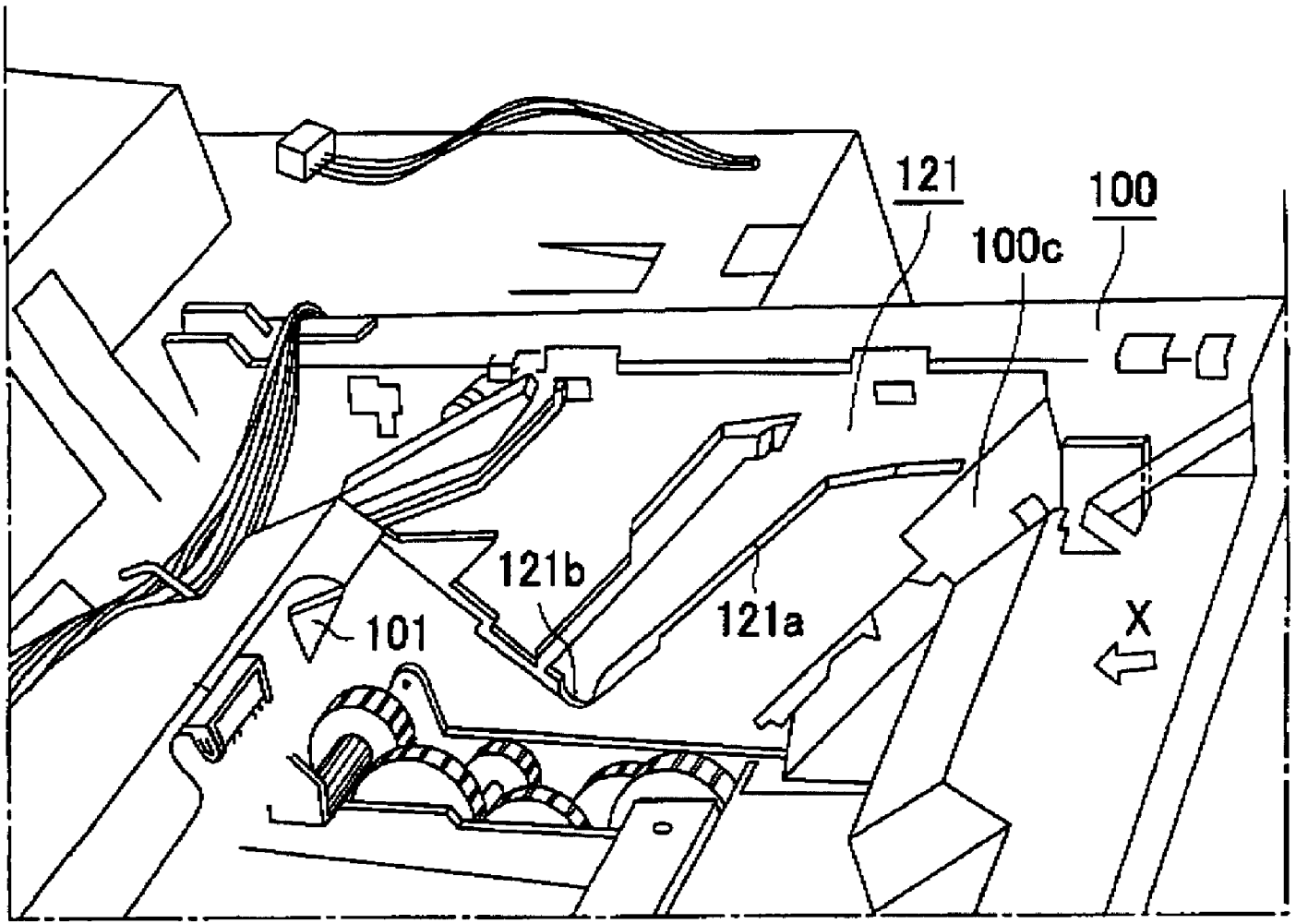
FIG. 5 is a perspective view of a mounting guide unit on the right of the first image-forming apparatus body according to the embodiment.
Figure 6:
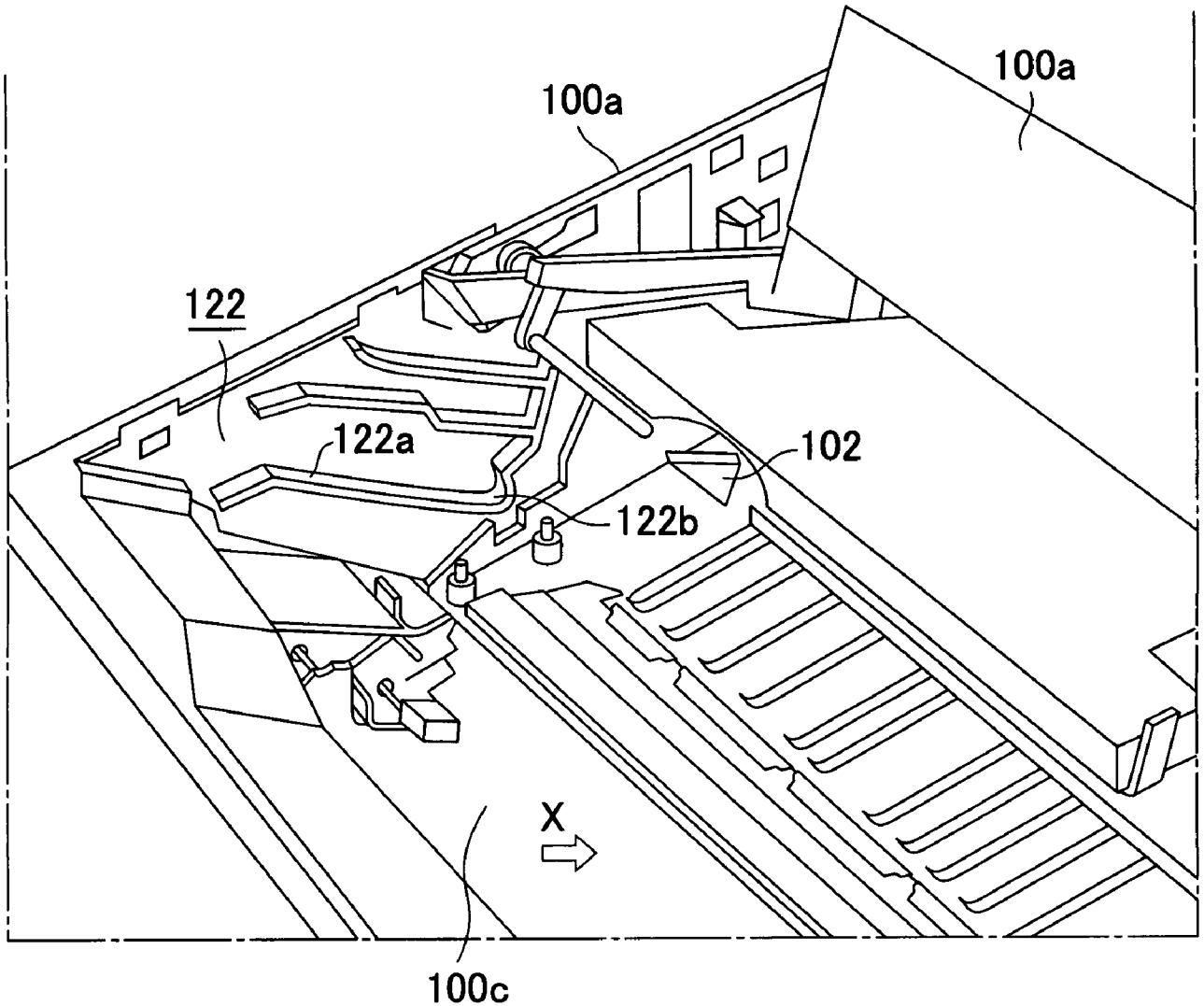
FIG. 6 is a perspective view of a mounting guide unit on the left of the first image-forming apparatus body according to the embodiment.
Figure 7:
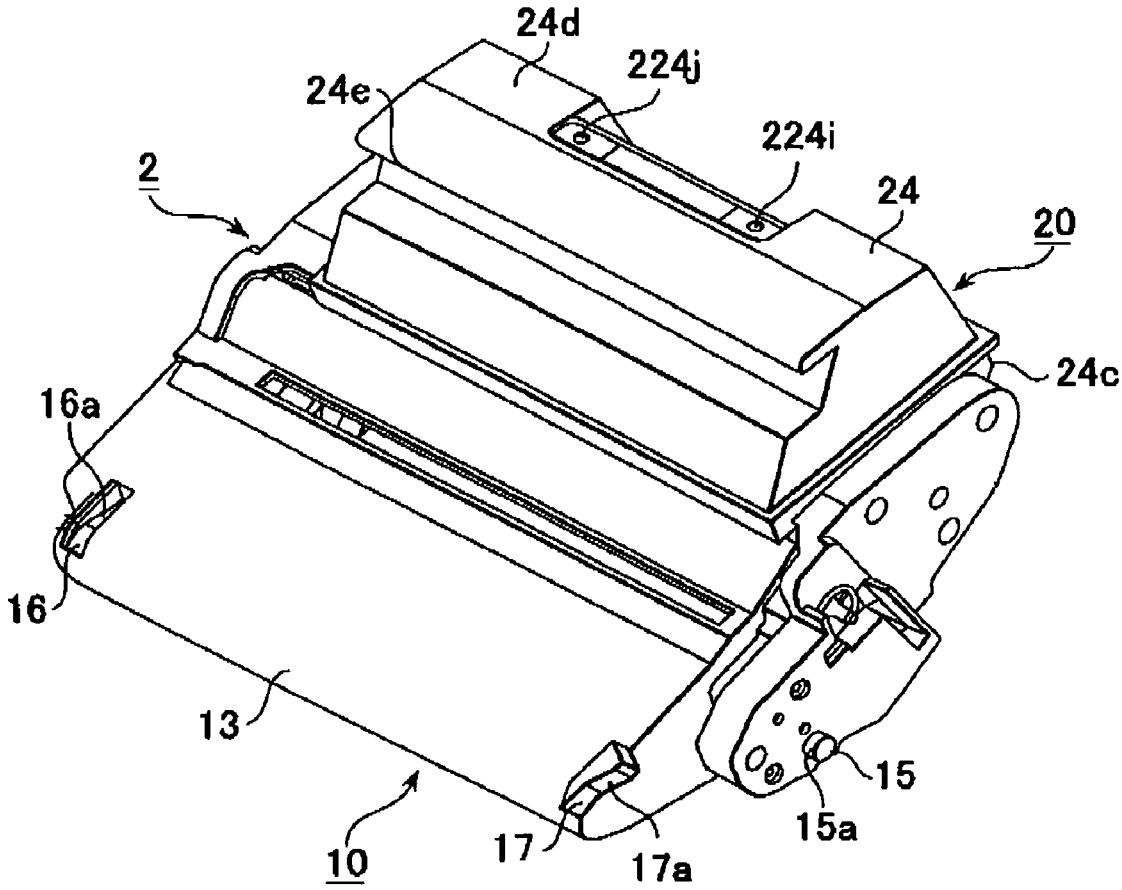
FIG. 7 is a perspective view of the first process cartridge according to the embodiment viewed from the left.
Figure 8:
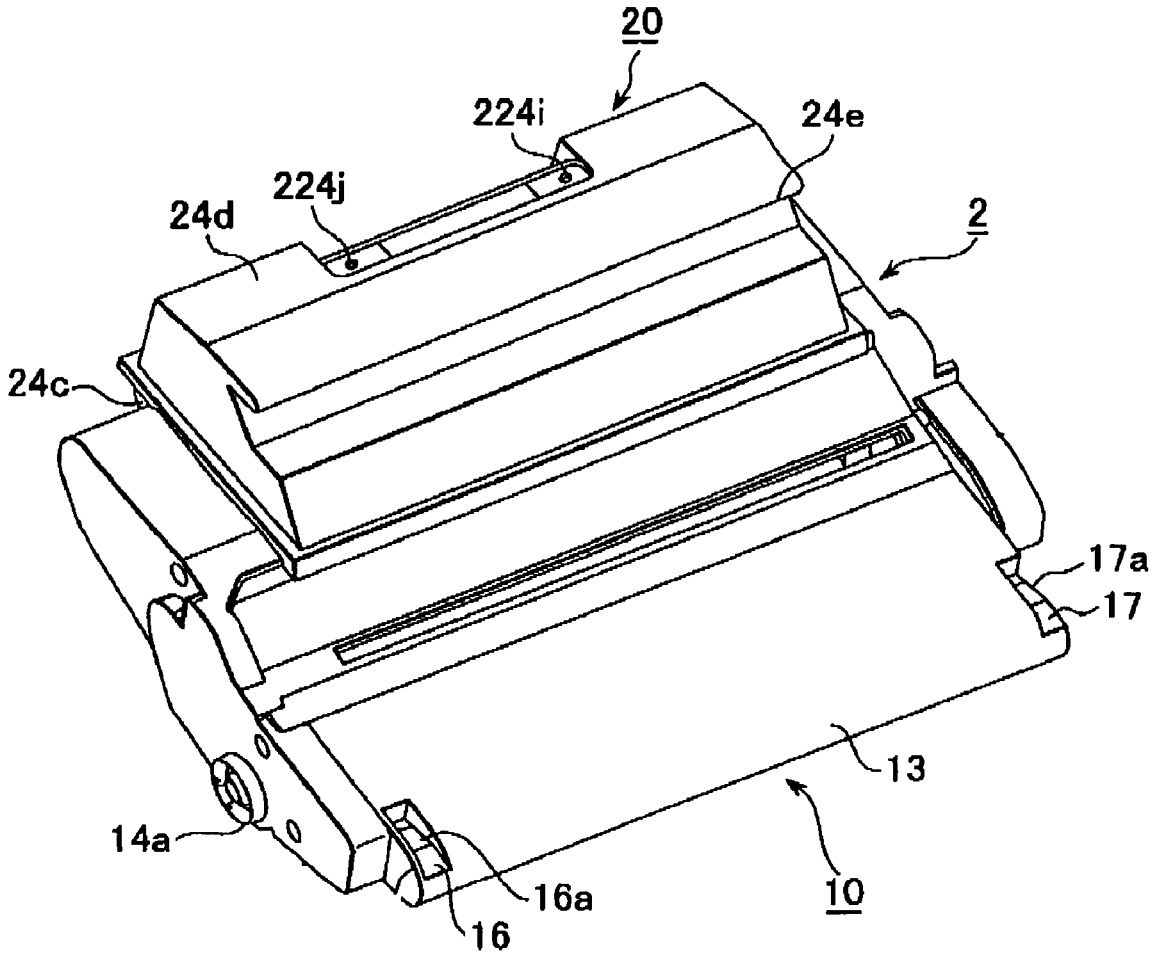
FIG. 8 is a perspective view of the first process cartridge according to the embodiment viewed from the right.

FIG. 5 is a perspective view partially showing the body of the first image-forming apparatus 100 located on the right of the developing unit 20 viewed from the surface of the feeding cassette 3*a*, which is the front of the body of the first image-forming apparatus 100, or from the installation surface of an operation unit 100*c*. FIG. 6 is a perspective view partially showing the body of the first image-forming apparatus 100 located on the left of the same developing unit 20. FIGS. 7 and 8 are overall perspective views of the first process cartridge according to the embodiment viewed from the left and right, respectively.

On both external sides of the cleaning unit 10, by the external surface of a cylinder section 14*a* of a drum bearing (not shown in drawings) and the external surface of a cylinder section 15*a* of a drum bearing 15, which are shown in FIGS. 7 and 8, the first process cartridge 2 is guided when the first process cartridge 2 is mounted on or dismounted off the bodyof the first apparatus 100.

As shown in FIGS. 7 and 8, on the upper surface (i.e., the upper surface when the first process cartridge 2 is mounted on the body of the first apparatus 100) of the drum frame 13 constituting the cleaning unit 10, which is part of the process cartridge body (unit body), there are provided restriction abutting portions 16*a* and 17*a* at ends thereof, respectively, in the longitudinal direction perpendicular to the mounting direction of the process cartridge. Both the restriction abutting portions 16*a* and 17*a* are arranged at terminals of grooves 16 and 17 extending in the mounting direction as mounting guides. When the first process cartridge 2 is mounted on the body of the first apparatus 100, the restriction abutting portions 16*a* and 17*a* define the rotational position of the first process cartridge 2.

That is, when the first process cartridge 2 is mounted on the body of the first apparatus 100, as shown in FIGS. 5 and 6, the extremities of fixed members 101 and 102, which are body-rotation restriction members, abut the restriction abutting portions 16*a* and 17*a*, respectively. Thereby, the rotational position of the first process cartridge 2 is defined about the cylinder section 14*a* of the drum bearing and the cylinder section 15*a* of the drum bearing 15.

(Mounting Method of Process Cartridge on First Apparatus)

Next, a mounting method of the first process cartridge 2 on the body of the first apparatus 100 will be described.

A user standing to face the mounting surface of the feeding cassette 3*a*, which is the front face of the body of the first apparatus 100, or a surface on which the operation unit 100*c* is arranged rotates an opening member 100*a* about a fulcrum 100*b* (see FIG. 2) so as to open the upper portion of the body of the first apparatus 100.

FIGS. 5 and 6 are partial perspective views of a mounting guide unit for guiding the first process cartridge 2 to the body of the first apparatus 100 on lateral both sides (viewed from the user). FIG. 5 shows the right internal wall of the body of the first apparatus 100 viewed by the user from the opening 100*c* opened by the opening member 100*a* while FIG. 6 shows the left internal wall.

On the right internal wall of the body of the first apparatus 100, a guide member (mounting unit) 121 shown in FIG. 5 is arranged while on the left internal wall, a guide member (mounting unit) 122 shown in FIG. 6 is formed.

The guide members 121 and 122 include guides 121*a* and 122*a* arranged so as to downward incline to the front viewed by a user of the first process cartridge 2, respectively. The guide members 121 and 122 are connected to the guides 121*a* and 122*a*, respectively, and also include semi-circular positioning grooves 121*b* and 122*b* into which the cylinder section 14*a* of the drum bearing and the cylinder section 15*a* of the drum bearing 15 are just fitted, respectively. The positioning grooves 121*b* and 122*b* have cylindrical peripheral walls, and the centers thereof agree with the centers of the cylinder section 14*a* of the drum bearing and the cylinder section 15*a* of the drum bearing 15, respectively, and with the axial line of the photosensitive drum 11 as well.

The width between the guide members 121 and 122 viewed from the direction mounting the first process cartridge 2 is loosely fitted with the cylinder section 14*a* of the drum bearing and the cylinder section 15*a* of the drum bearing 15.

A user grips the gripper portions 24*e* and 24*f* of the first process cartridge 2 so as to mount the first process cartridge 2 onto the first apparatus 100 from the X-direction. The cylinder section 14*a* of the drum bearing and the cylinder section 15*a* of the drum bearing 15 of the first process cartridge 2 are inserted along the guides 121*a* and 122*a*, and fitted into the positioning grooves 121*b* and 122*b* of the guide members 121 and 122 of the first apparatus 100, respectively. Furthermore, the restriction abutting portions 16*a* and 17*a* on both sides of the drum frame 13 of the first process cartridge 2 are abutted to the extremities of the fixed members 101 and 102 of the first apparatus 100, respectively. In the first apparatus 100, the mounting direction X of the first process cartridge 2 agrees with the direction B in that the feeding cassette 3*a* is mounted on the first apparatus 100. The mounting directions X and B intersect with the axial line of the photosensitive drum 11.

Finally, upon closing the opening member 100*a* so as to close the opening 100*c*, the mounting of the first process cartridge 2 on the first apparatus 100 is completed.

Next, a second image-forming apparatus (referred to as a second apparatus below) 300 using the process cartridge according to the embodiment will be described.

Figure 9:
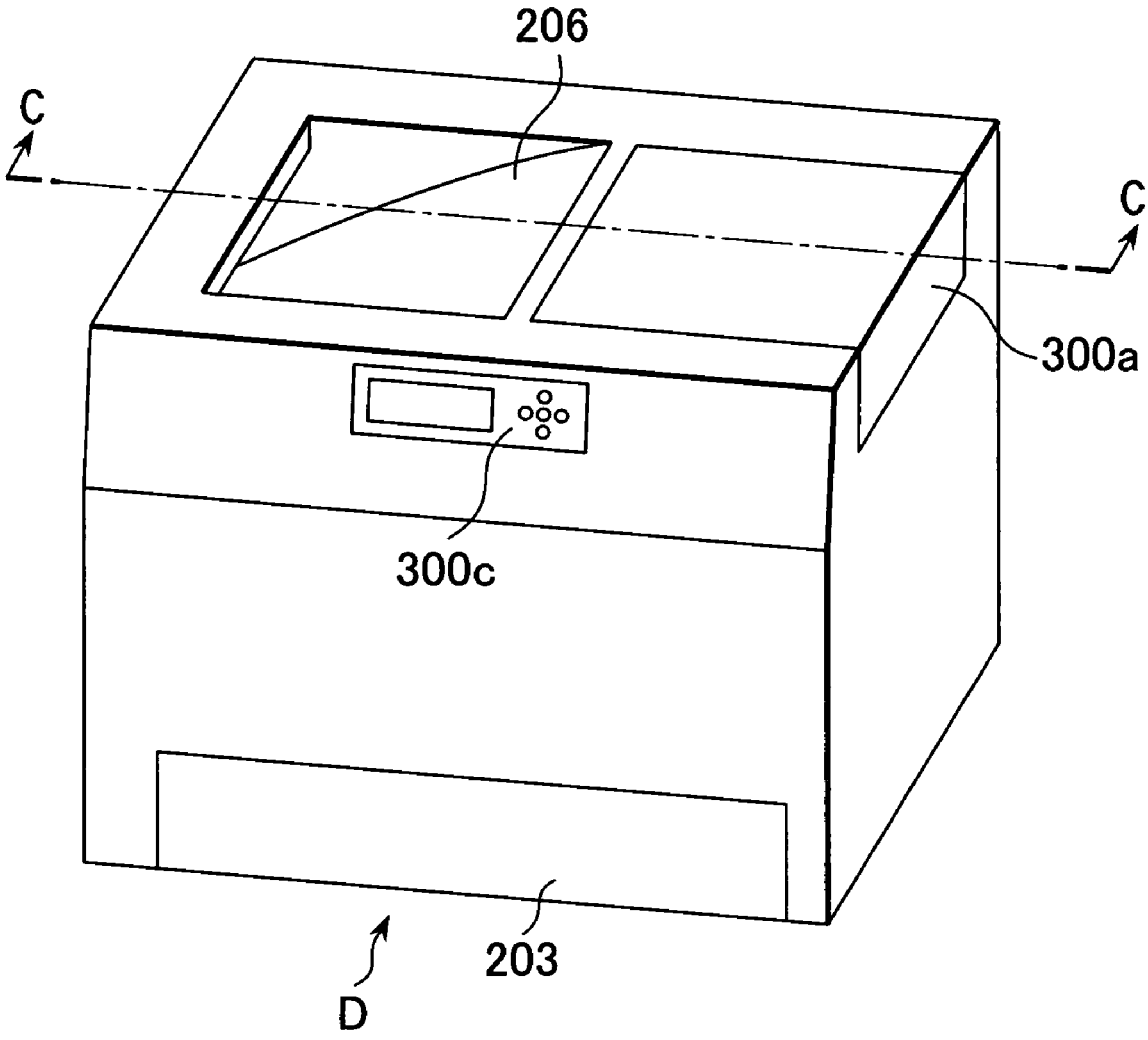
FIG. 9 is an external perspective view of a second image-forming apparatus body according to the embodiment.
Figure 10:
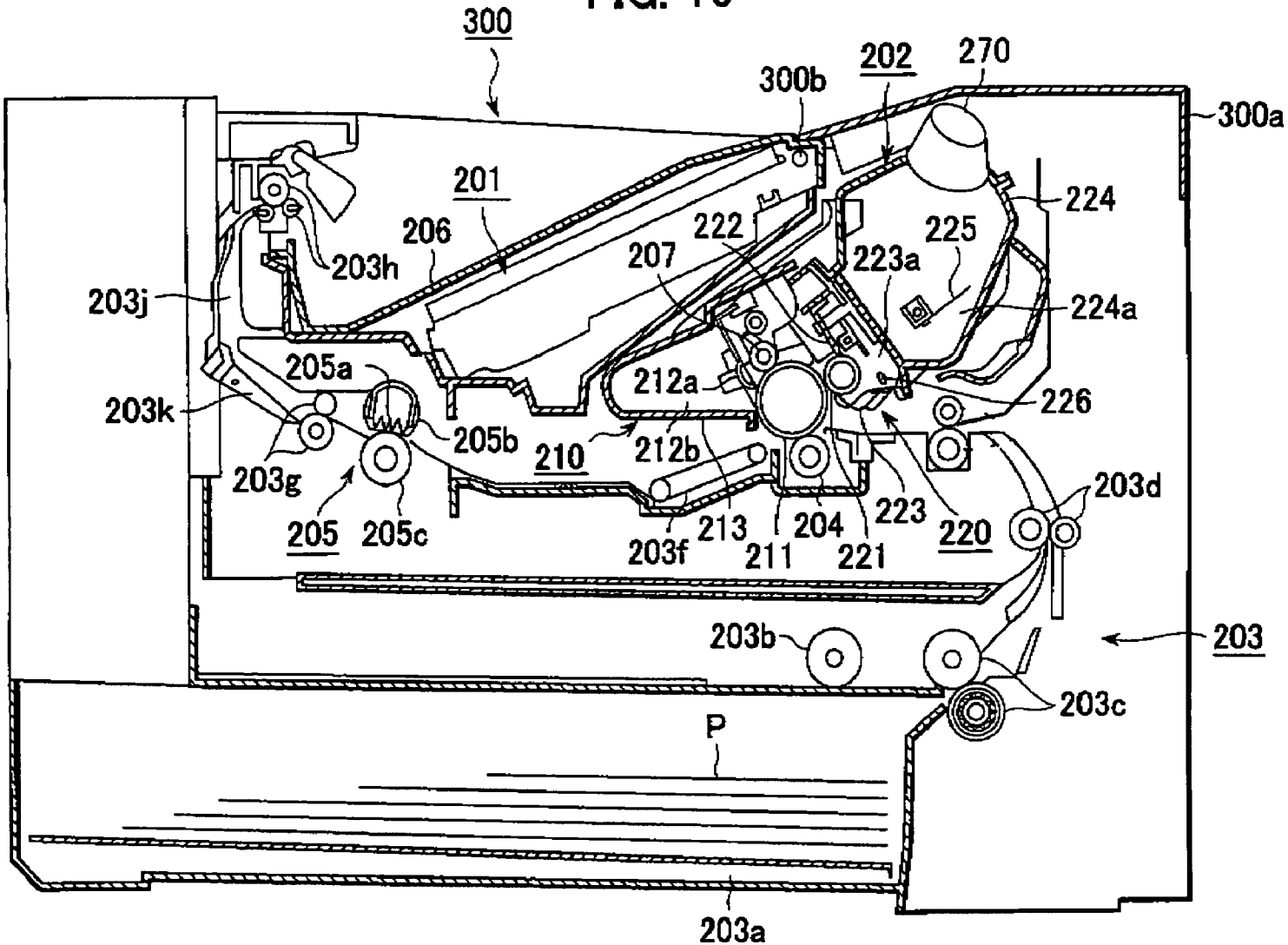
FIG. 10 is a sectional view of the second image-forming apparatus body according to the embodiment at the line C—C.

FIG. 9 is an external perspective view of the second apparatus 300 according to the embodiment; and FIG. 10 is a sectional view of the second apparatus 300 at the line C—C of FIG. 9.

The second apparatus 300 includes an optical unit 201 having a laser diode, a polygon mirror, a lens, and a reflection mirror. By applying a laser beam corresponding to image information obtained from the optical unit 201, a latent image corresponding to the image information is formed on an electrophotographic photosensitive drum 211 of a second process cartridge 202. This latent image is developed by a developing unit so as to be a visible image, i.e., a toner image.

Also, the second apparatus 300 is installed so as to direct a surface, on which an operation unit 300*c* or a feeding cassette 203 is arranged, to the front, so that a user mounts or dismounts the second process cartridge 202 by opening an opening member 300*a* disposed on the right.

At this time, in order to improve the efficiency in mounting the process cartridge, the second process cartridge 202 is provided with a handle member 270.

Furthermore, the second apparatus 300, different from the first apparatus 100 in structure and function, is set to have an image-forming rate slower than that of the first apparatus 100.

Therefore, the first process cartridge 2 for use in the first apparatus 100 is available without modifications in the second apparatus 300. Moreover, since it is used in the apparatus with the slower image-forming rate, bearing materials of the developing roller 21 and the photosensitive drum 11 and grease therefore may be inexpensive ones with insufficient sliding characteristics.

Figure 11:
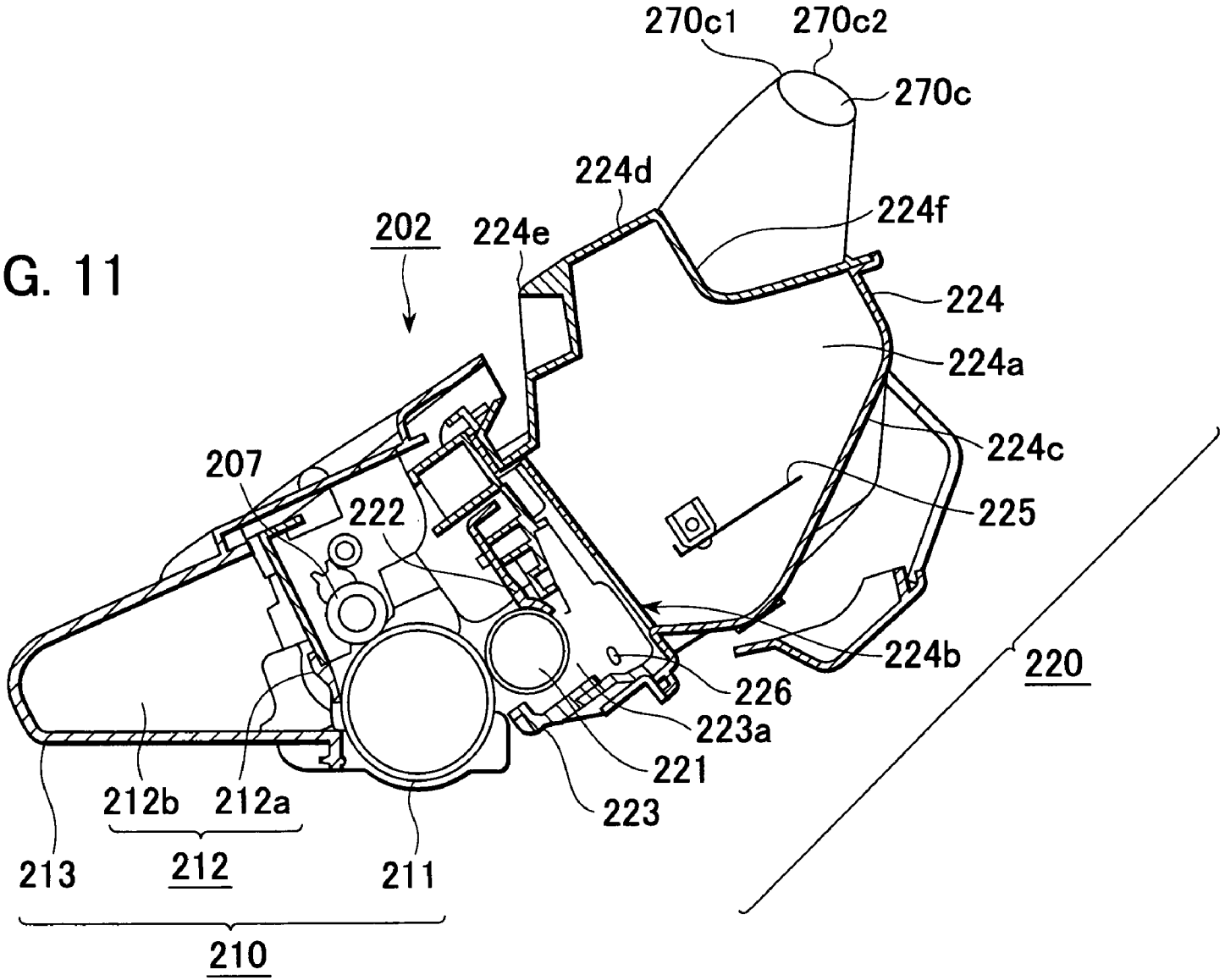
FIG. 11 is a longitudinal sectional view of a second process cartridge according to the embodiment.

Therefore, according to this structure, the second process cartridge 202 (FIG. 11) in that the bearing materials of the developing roller 21 and the photosensitive drum 11 and the grease therefore are changed while other components are entirely common to the first process cartridge 2 will be described. FIG. 11 is a longitudinal sectional view of the second process cartridge 202 according to the embodiment.

Image-forming units of the second apparatus 300 and the second process cartridge 202 are the same as those of the first apparatus 100 and the first process cartridge 2, so that the description thereof is omitted, and only changes will be described.

Reference numerals of components of the second apparatus 300 and the second process cartridge 202 are expressed by adding 200 to those of the first apparatus 100 and the first process cartridge 2.

(Structure of Guide Unit for Mounting Process Cartridge)

A mounting guide unit for mounting or dismounting the second process cartridge 202 on or off the second apparatus 300 will be described with reference to FIGS. 12 and 13.

Figure 12:
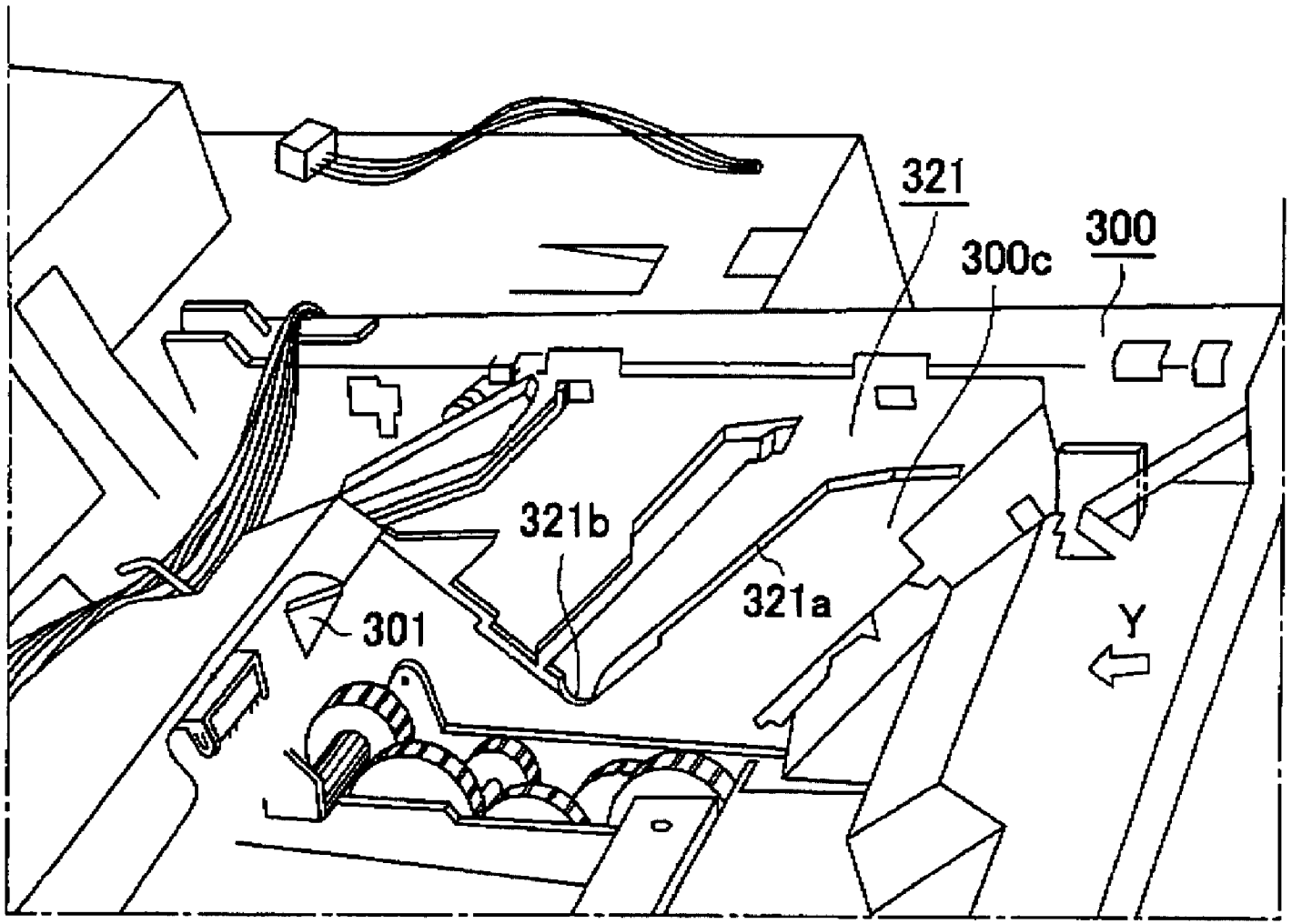
FIG. 12 is a partial perspective view of a mounting guide unit on the backside of the second image-forming apparatus body according to the embodiment.

FIG. 12 is a perspective view of part of the second apparatus 300 located back a developing unit 200 viewed from the front of the second apparatus 300 (from an operation unit 300*c* or a surface mounting a feeding cassette 203); FIG. 13 is a perspective view of part of the second apparatus 300 located in front of the same developing unit 220; and FIGS. 14 and 15 are overall perspective views of the second process cartridge according to the embodiment viewed from the front and the back thereof, respectively.

Figure 14:
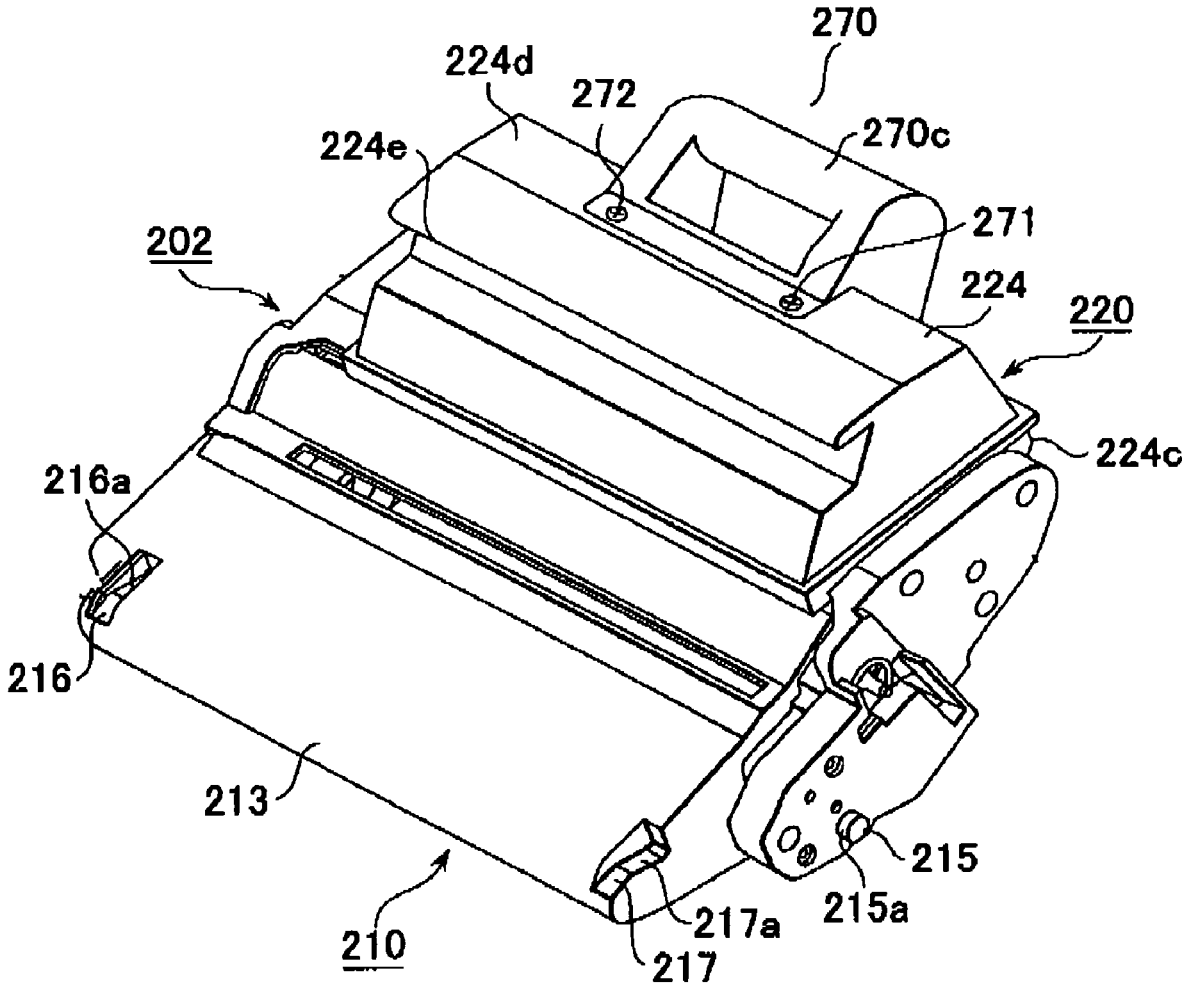
FIG. 14 is a perspective view of the second process cartridge according to the embodiment viewed from the front.
Figure 15:
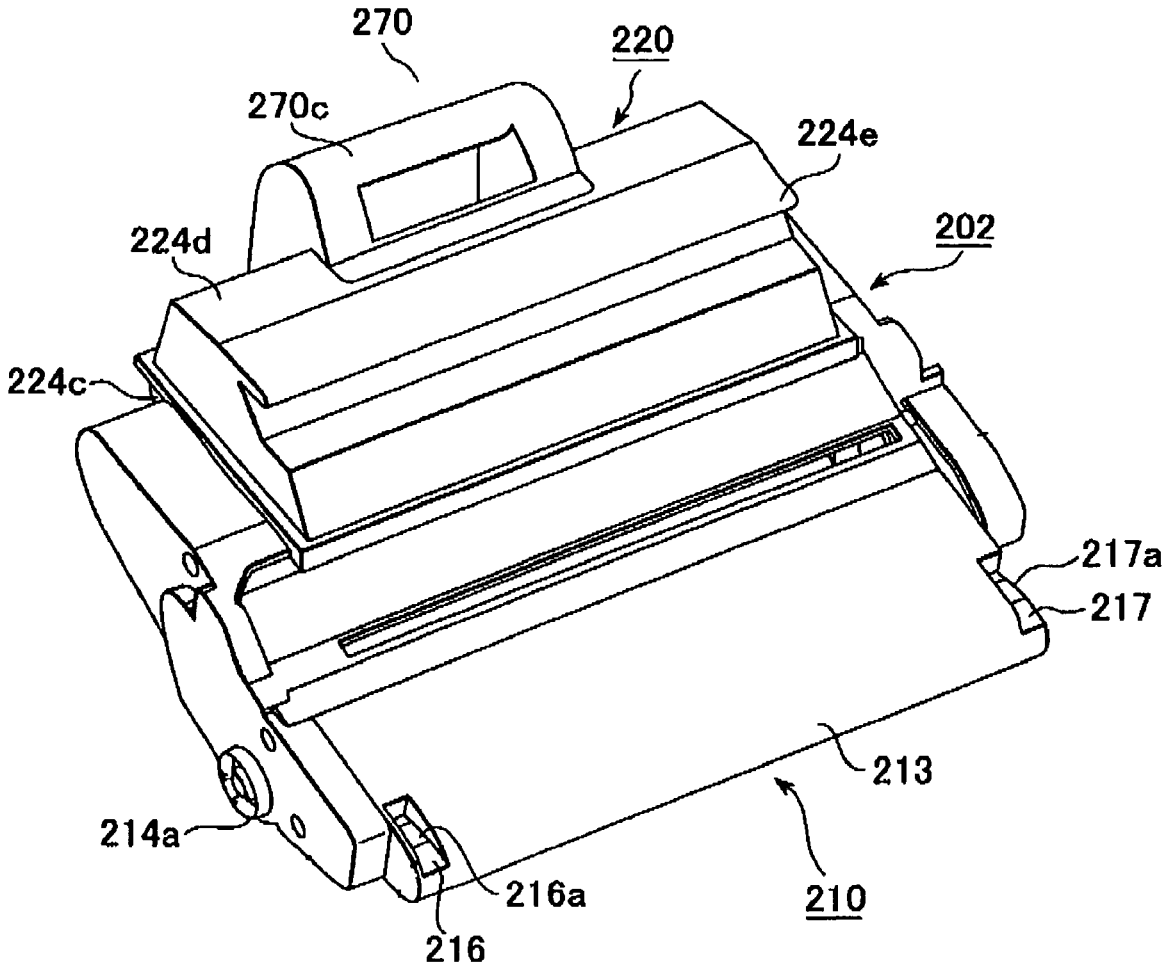
FIG. 15 is a perspective view of the second process cartridge according to the embodiment viewed from the backside.

On both external sides of a cleaning unit 210, external surfaces of a cylinder section 214*a* of a drum bearing (not shown in drawings) and a cylinder section 215*a* of a drum bearing 215 shown in FIGS. 14 and 15 are guided when the second process cartridge 202 is mounted on or dismounted off the second apparatus 300.

As shown in FIGS. 14 and 15, on the upper surface (i.e., the upper surface when the second process cartridge 202 is mounted on the second apparatus 300) of a drum frame 213 constituting the cleaning unit 210, which is the process cartridge body (unit body), restriction abutting portions 216*a* and 217*a* are provided at ends in the longitudinal direction perpendicular to the mounting direction of the process cartridge. The restriction abutting portions 216*a* and 217*a* are arranged at ends of grooves 216 and 217 which are mounting guides extending in the mounting direction for defining the rotational position of the second process cartridge 202 when the second process cartridge 202 is mounted on the second apparatus 300.

Figure 13:
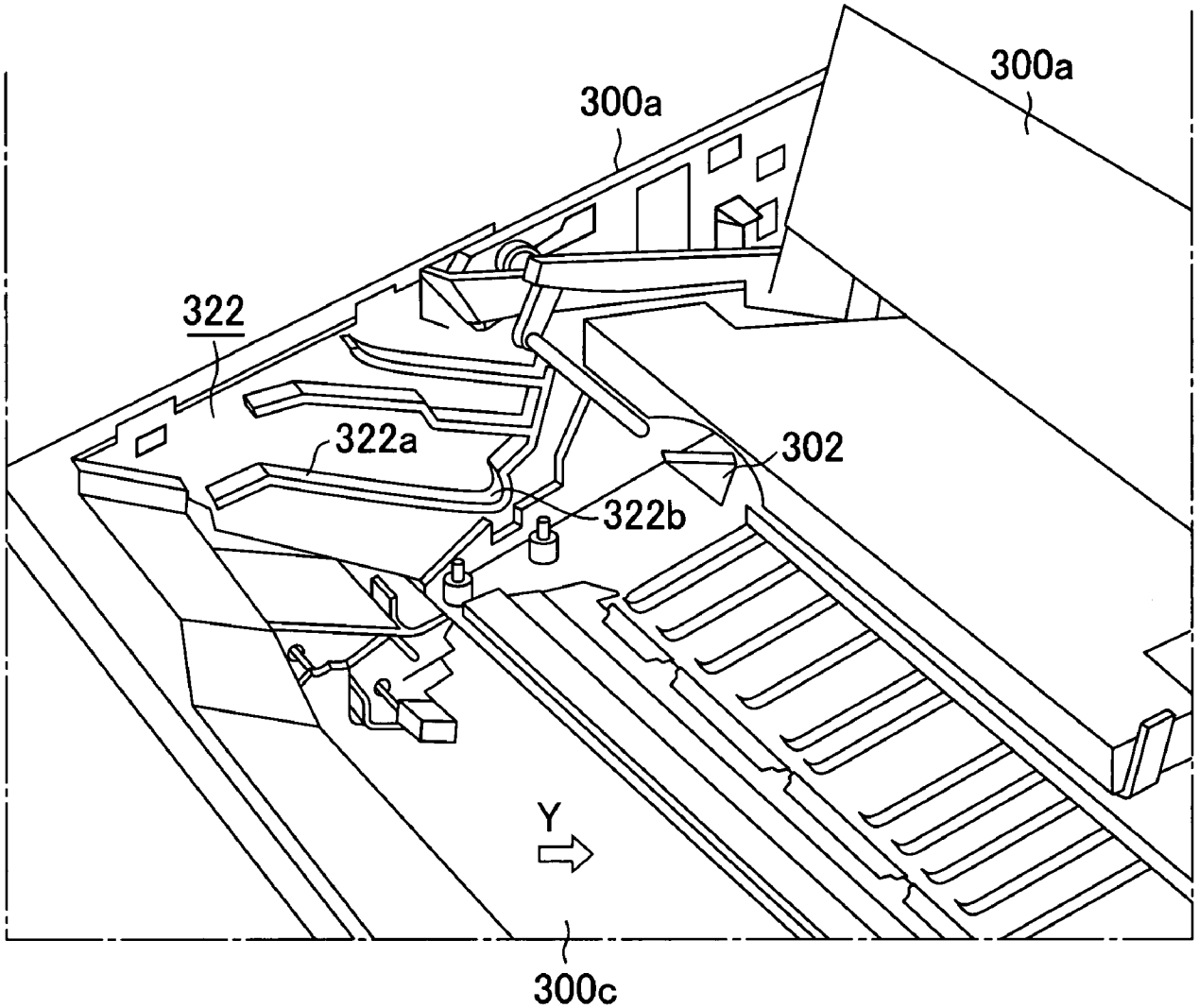
FIG. 13 of a partial perspective view of a mounting guide unit on the front side of the second image-forming apparatus body according to the embodiment.

That is, when the second process cartridge 202 is mounted on the second apparatus 300, as shown in FIGS. 12 and 13, ends of fixed members 301 and 302, which are body rotational restriction members provided in the second apparatus 300, abut the restriction abutting portions 216*a* and 217*a*, respectively. Thereby, the rotational positions of the second process cartridge 202 about a cylinder section 214*a* of a drum bearing and a cylinder section 215*a* of a drum bearing 215 are defined.

(Mounting Method of Process Cartridge on Second Apparatus)

Then, a mounting method of the second process cartridge 202 on the second apparatus 300 by a user will be described.

When a user stands in front of the mounting surface of the feeding cassette 203 or the operation unit 300*c* so as to rotate the operation unit 300*c* about a fulcrum 300*b* (see FIG. 10), the upper section of the second apparatus 300 is opened.

FIGS. 12 and 13 are partial perspective views of a mounting unit onto the second apparatus 300 in front and on both backsides of the second process cartridge 202 in this state (near side from the user and on both back sides), respectively; FIG. 12 shows the backside of bilateral internal walls of the second apparatus 300 viewed from the opening 300*c* opened by the opening member 300*a* by a user as mentioned above; and FIG. 13 shows the front side.

On the internal wall on the backside of the second apparatus 300, as shown in FIG. 12, a guide member 321 (mounting unit) is arranged while on the internal wall on the near side, a guide member 322 (mounting unit) shown in FIG. 13 is formed.

The guide members 321 and 322 include guides 321*a* and 322*a* arranged so as to downward incline to the left viewed by a user, respectively. The guide members 321 and 322 are connected to the guides 321*a* and 322*a*, respectively, and also include semi-circular positioning grooves 321*b* and 322*b* into which the cylinder section 214*a* of the drum bearing and the cylinder section 215*a* of the drum bearing 215 are just fitted, respectively.

The positioning grooves 321*b* and 322*b* have cylindrical peripheral walls, and the centers thereof agree with the centers of the cylinder section 214*a* of the drum bearing and the cylinder section 215*a* of the drum bearing 215 of the second process cartridge 202 when the second process cartridge 202 is mounted on the second apparatus 300, respectively, and with the axial line of a photosensitive drum 211 as well.

The width between the guide members 321 and 322 viewed from the direction mounting the first process cartridge 2 is loosely fitted with the cylinder section 214*a* of the drum bearing and the cylinder section 215*a* of the drum bearing 215.

A user grips the handle member 270 of the second process cartridge 202 so as to mount the second process cartridge 202 onto the second apparatus 300 from the Y-direction. The cylinder section 214*a* of the drum bearing and the cylinder section 215*a* of the drum bearing 215 of the second process cartridge 202 are inserted along the guides 321*a* and 322*a*, and fitted into the positioning grooves 321*b* and 322*b* of the guide members 321 and 322 of the second apparatus 300, respectively. Furthermore, the restriction abutting portions 216*a* and 217*a* on both sides of the drum frame 213 of the second process cartridge 202 are abutted to the extremities of the fixed members 301 and 302 of the second apparatus 300, respectively. In the second apparatus 300, the mounting direction Y of the second process cartridge 202 intersects with the direction D in that the cassette 203 is mounted onto the second apparatus 300. The mounting directions D agrees with the axial line of the photosensitive drum 211.

Finally, upon closing the opening member 300*a* so as to close the opening 300*c*, the mounting of the second process cartridge 202 onto the second apparatus 300 is completed.

(Mounting Structure of Handle Member)

Figure 16:
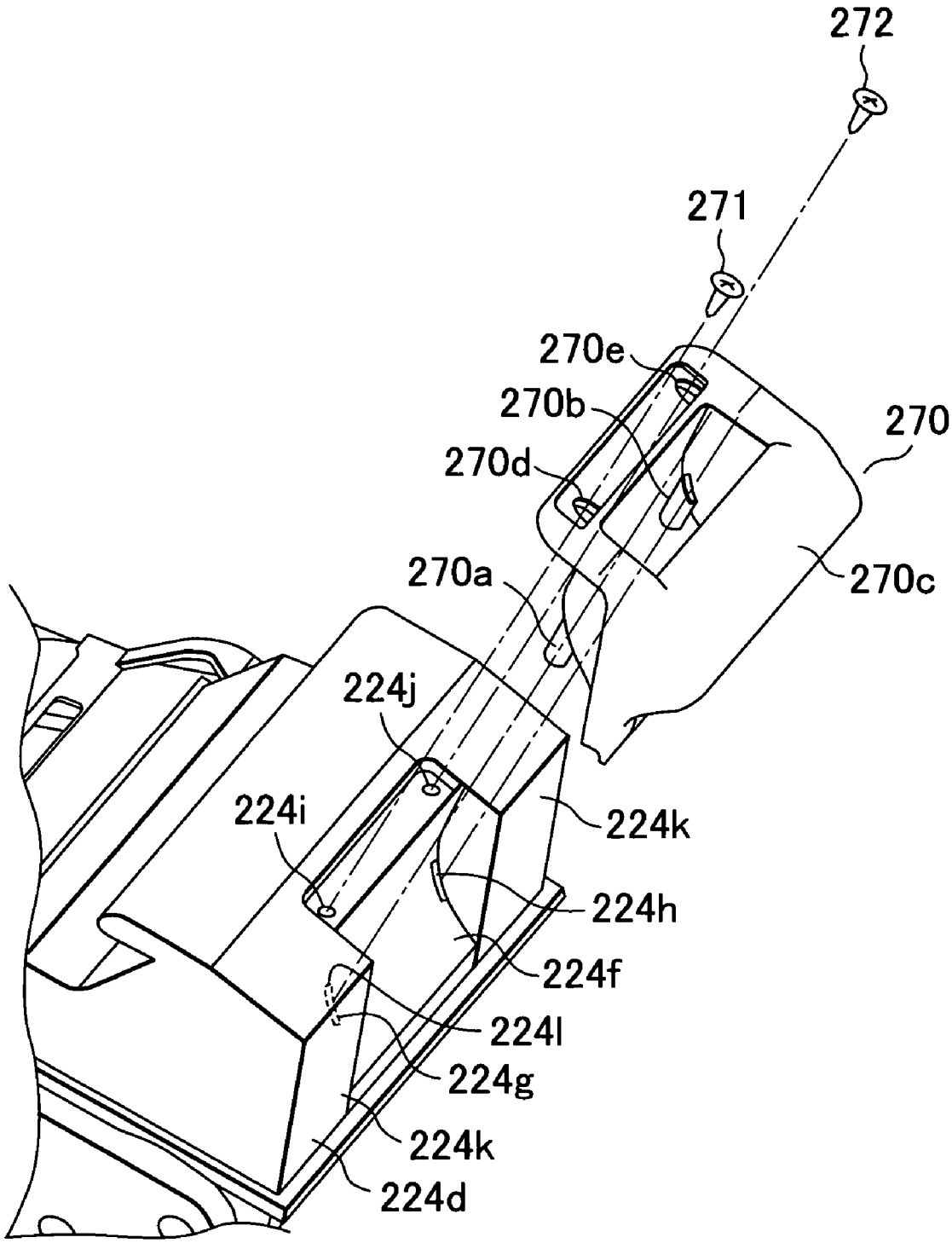
FIG. 16 is an exploded perspective view showing a state that a handle member according to the embodiment is attached to the process cartridge.

Next, the mounting structure of the handle member 270 of the second process cartridge 202 will be described with reference to FIG. 16. FIG. 16 is an exploded perspective view showing a state that the handle member 270 is attached to the process cartridge.

As shown in FIG. 16, the second process cartridge 202 to be mounted onto the second apparatus 300 is provided with positioning units 224*g* and 224*h* for positioning by fitting positioning bosses 270*a* and 270*b* of the handle member 270 into a gripper portion 224*f* of a toner-container upper frame 224*d* constituting the toner container 224. In the upper portion of the gripper portion 224*f* of the toner-container upper frame 224*d*, the handle member 270 can be attached to fixation portions 224*i* and 224*j* with screws 271 and 272. The screws 271 and 272 are screwed into the fixation portions 224*i* and 224*j* after passing through holes 270*d* and 270*e* formed in the handle member 270. In addition, the fixation portions 224*i* and 224*j* may also be located at positions other than the gripper portion 224*f* which is a recess. The gripper portion 224*f* is a recess being concave from external surfaces 224*k* and 2241 of the toner-container upper frame 224*d*. Thereby, a space for accommodating a finger is ensured without needlessly increasing the second process cartridge 202 in size. The position of the handle member 270 is also visually recognizable (at this time, a space for accommodating a finger can be ensured without a recess. However, for ensuring a space for accommodating a finger on the toner-container upper frame 224*d*, the handle member 270 largely protrudes from the outer surface of the second process cartridge 202, so that the second process cartridge 202 is increased in size). That is, the handle member 270 can be located substantially at the same position as that of the gripper portion 224*f* in the axial direction of the drum bearing 215. Therefore, an operator can easily recognize the position of the handle member 270, improving operationality.

Therefore, the handle member 270 is attached at a position opposing the concave gripper portion 224*f*. That is, the handle member 270 is attached so as to have a space between the handle 270*c* of the handle member 270 and the concave gripper portion 224*f*. The positioning units 224*g* and 224*h* and the fixation portions 224*i* and 224*j* for the handle member 270 may be arranged in the gripper portion 224*f* or in the vicinity of the gripper portion 224*f*. That is, the handle member 270 is arranged so as to overlap with the gripper portion 224*f* in a direction intersecting with the axial direction of the photosensitive drum 211.

Figure 17:
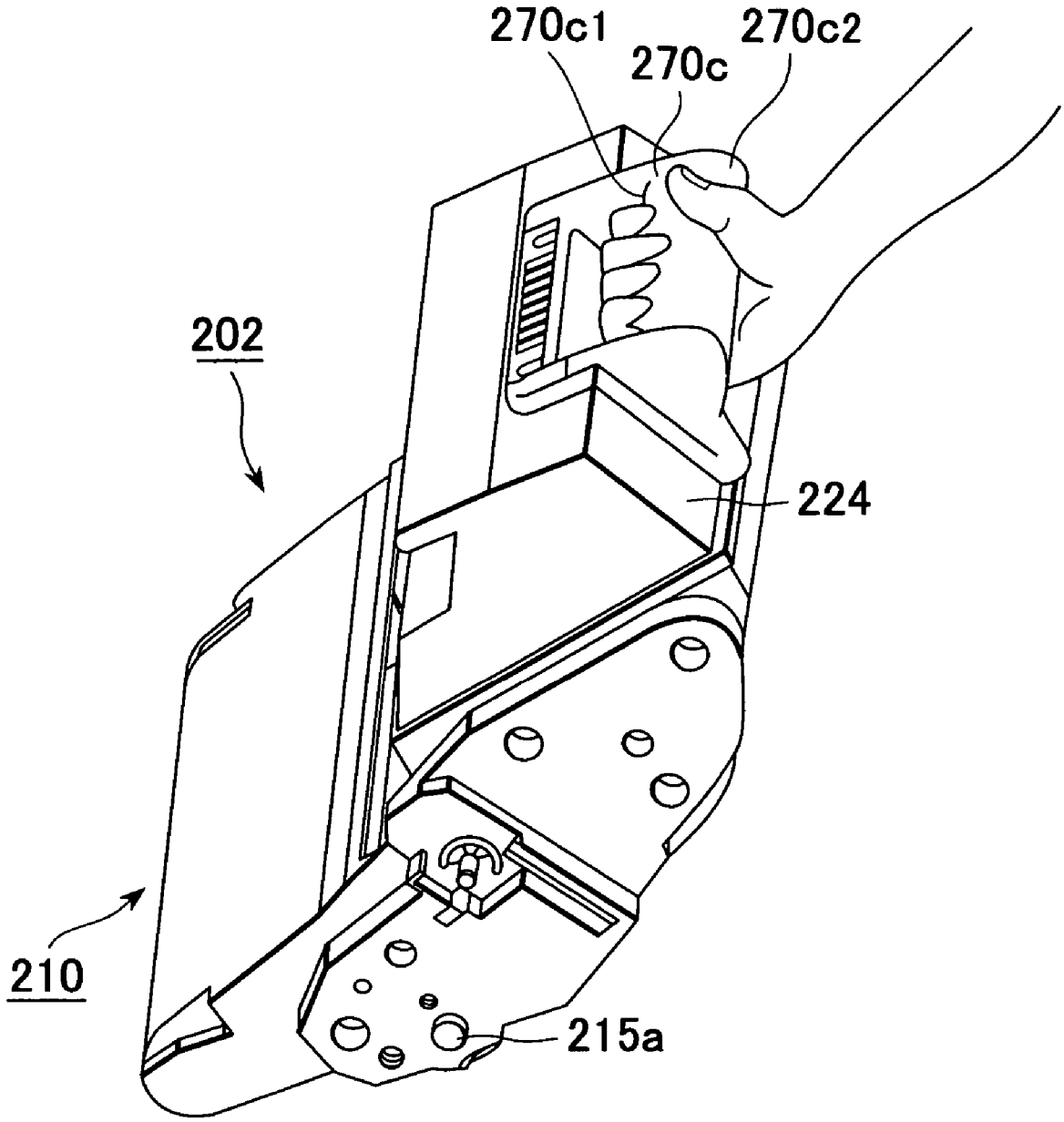
FIG. 17 is a perspective view showing a state that the second process cartridge having the handle member attached thereto according to the embodiment is gripped.
Figure 18:
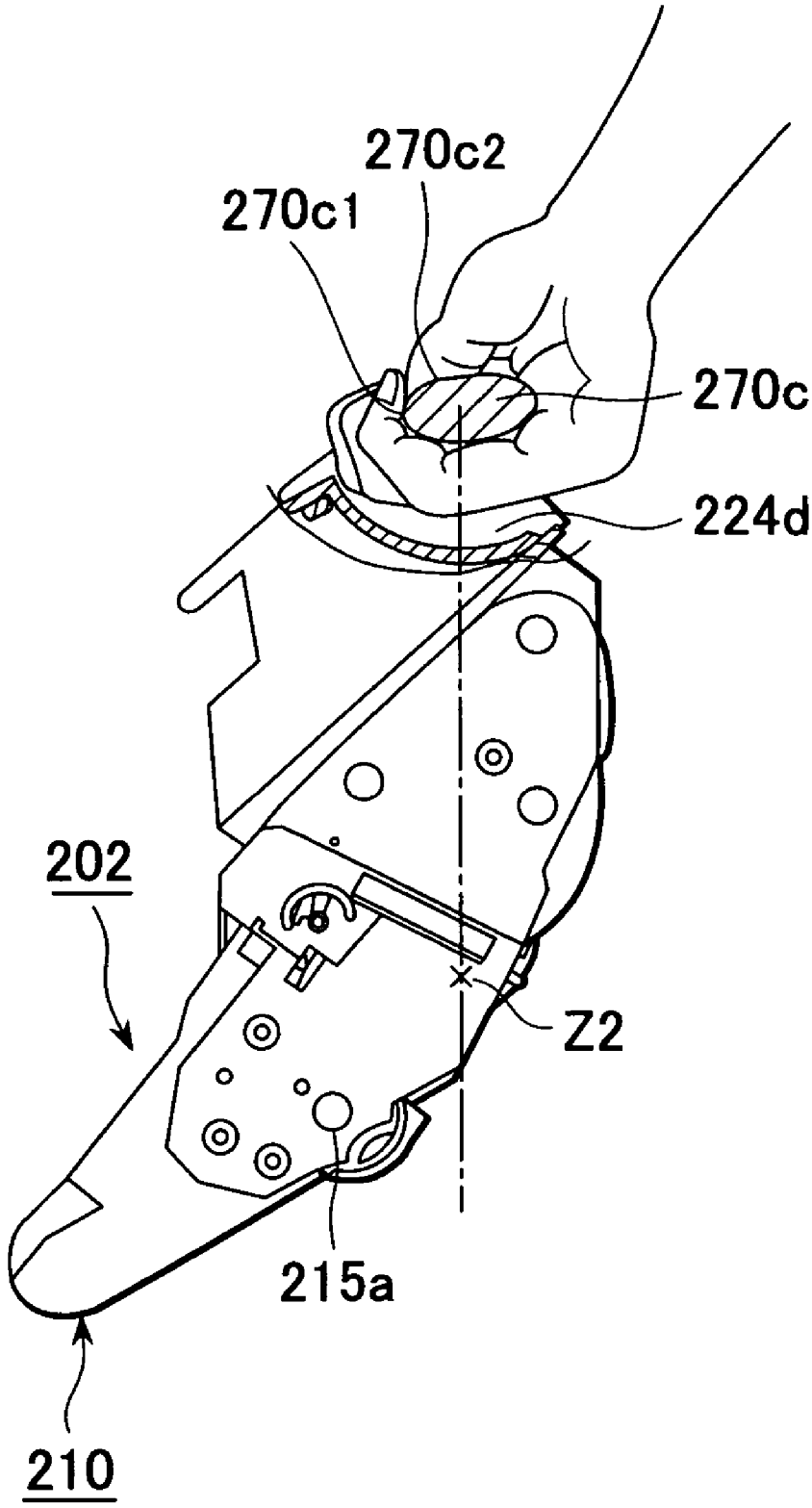
FIG. 18 is a side view showing a method for gripping the second process cartridge having the handle member attached thereto according to the embodiment.

FIGS. 17 and 18 show states that the handle member 270 of the second process cartridge 202 having the handle member 270 attached thereto is gripped.

At this time, as shown in FIG. 18, when a user grips the handle 270*c* of the handle member 270, the second process cartridge 202 assumes a posture that the center of gravity Z2 is positioned immediately below the handle 270*c* in the vertical direction. That is, the cleaning unit 210 is falling downward. At this time, the section of the handle 270*c* on the plane intersecting with the axial line of the photosensitive drum 211 is broad in the substantially horizontal direction. Also, the handle 270*c* has a shape extending in axial direction of the photosensitive drum 211.

According to the embodiment, the handle 270*c* has widths of 33 mm in the horizontal direction and 17 mm in the vertical direction, corresponding to hand sizes over extensive users.

Thereby, the handle 270*c* can be gripped with the entire palm by hooking fingers other than a thumb on the handle 270*c* at the extremity 270*c* 1 in the direction mounting the process cartridge of the handle member 270 as well as by attaching the thumb on the upper surface 270*c* 2 of the handle member 270. That is, an operator can grip the handle member 270 by inserting the hand into a space between the handle 270*c* and the concave gripper portion 224*f*, i.e., the handle 270*c* is gripped by directing the palm upward. Therefore, without requiring an excessive force, the second process cartridge 202 can be easily mounted on the second apparatus 300 by guiding the cylinder section 214*a* of the drum bearing and the cylinder section 215*a* of the drum bearing 215 of the second process cartridge 202 along the guide members 321 and 322 of the second apparatus 300. That is, by gripping the second process cartridge 202 from the direction intersecting with the direction Y mounting the second process cartridge, the second process cartridge 202 can be easily mounted on the second apparatus 300.

Figure 19:
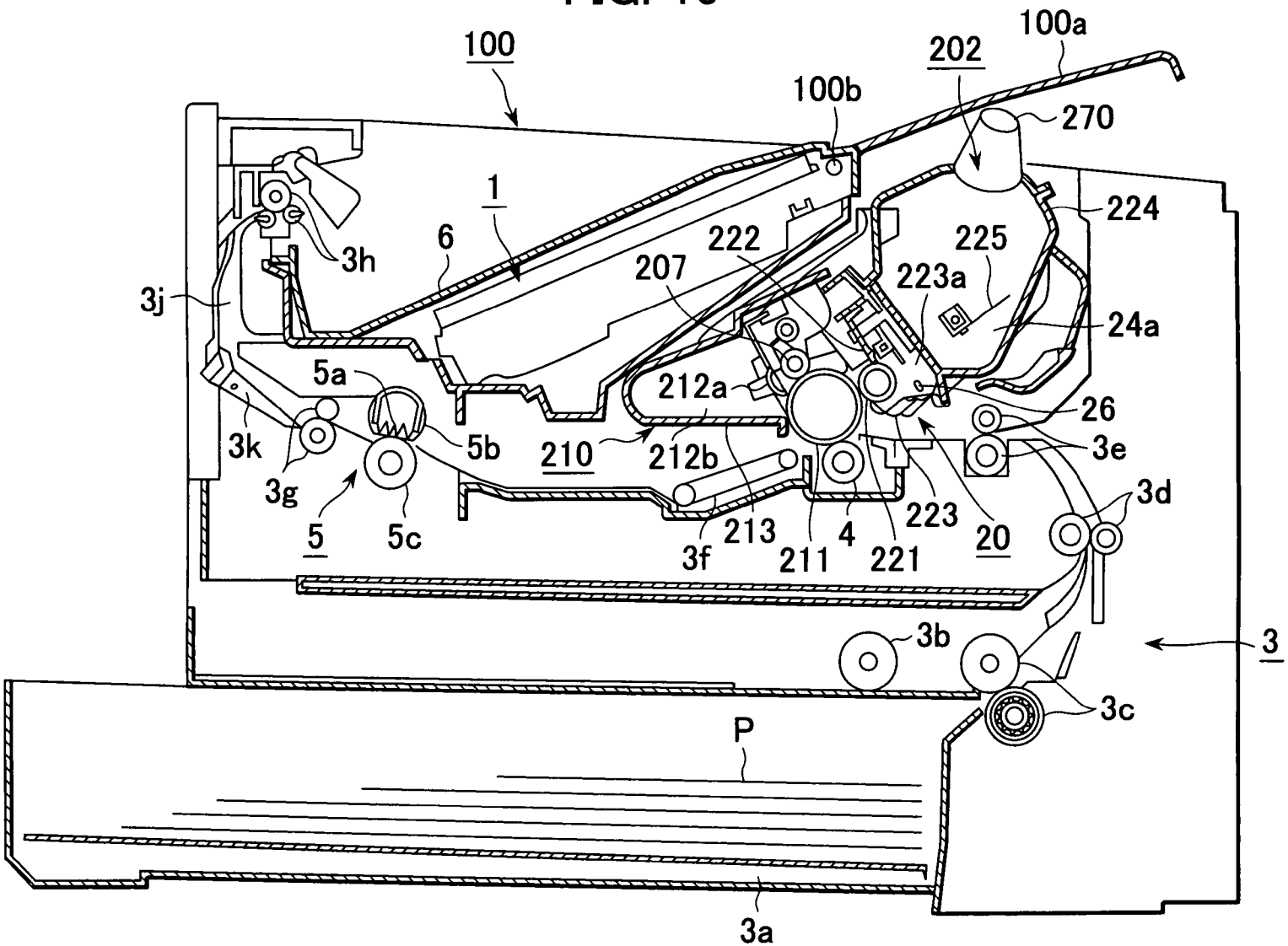
FIG. 19 is a sectional view showing a state that the second process cartridge having the handle member attached thereto according to the embodiment is mounted on the first image-forming apparatus.

FIG. 19 is a sectional view showing a state that the second process cartridge having the handle member attached thereto according to the embodiment is mounted on the first image-forming apparatus. As shown in FIG. 19, if the second process cartridge 202 is to be mounted on the first apparatus 100 with the handle member 270 attached to the second process cartridge 202, the mounting cannot be accomplished because the opening member 100*a* hits the handle member 270 when the opening member 100*a* is closed.

Thereby, it can be prevented that problems arise from miss-mounting the second process cartridge 202 with a printing rate not corresponding to that of the first apparatus 100, such as abnormal abrasion or fusion of sliding parts. And, when a scanner for reading an original is mounted on the upper part of the second apparatus 300, the opening angle of the opening member 300*a* might be restricted. Even in such a case, the process cartridge 202 can be well inserted into or removable from the second apparatus 300 by the handle member 270 attached to the process cartridge 202.

When the above description is summarized, according to the embodiment of the present invention, in the process cartridge in that the first process cartridge 2 can be mounted on the first image-forming apparatus 100 from the front direction of the body (of the surface mounting the feeding cassette or the operation unit) while the second process cartridge 202 can be mounted on the second image-forming apparatus 300 from the lateral face direction of the body, i.e., the direction mounting the feeding cassette or the direction intersecting with that of the operation unit, instead of the handle gripped when the first process cartridge is mounted on the first apparatus, there are provided the mounting portions 224*i*, 224*j*, 224*g*, and 224*h* capable of attaching the handle member 270 gripped when being mounted on the second apparatus, preventing the cost from increasing.

The second process cartridge 202 for the second apparatus is improved in operationality in mounting the second process cartridge 202 on the second apparatus 300 by adding the handle member 270 to the first process cartridge.

Also, since the mounting portions 224*i*, 224*j*, 224*g*, and 224*h* of the handle member are provided in the recess being concave lower than the vicinity, the handle member cannot needlessly protrude from the external surface of the process cartridge, enabling the process cartridge and the body to be miniaturized. According to the embodiment, the mounting portions 224*i*, 224*j*, 224*g*, and 224*h* are arranged integrally with the toner-container upper frame 224*d*; alternatively, the mounting portions may be arranged separated from the toner-container upper frame 224*d*. Also, without affecting the toner containing amount of the first and second process cartridges, the second process cartridge 202 can be formed to be easily gripped.

Furthermore, when the condition is necessary to be set in that by the difference in structure and functions between the first apparatus 100 and the second apparatus 300, the first process cartridge 2 can be mounted on the first and second apparatuses while the second process cartridge 202 can be mounted only on the second apparatus but not on the first apparatus, by attaching the handle member 270 to the first process cartridge, the second process cartridge can be configured to have a non-compatible structure.

As described above, according to the present invention, by achieving commonality of the cartridge-frame structure of the process cartridge, the system can corresponds to a first electrophotographic image-forming apparatus and a second electrophotographic image-forming apparatus to be mounted by the process cartridge from a direction different from that of the first electrophotographic image-forming apparatus.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An assembling method of a process cartridge comprising the steps of:

providing the process cartridge comprising an electrophotographic photosensitive drum, processing means for acting on the electrophotographic photosensitive drum, and a gripper portion formed in a cartridge frame for gripping the process cartridge when the process cartridge is mounted on a body of an electrophotographic image-forming apparatus; and attaching a handle member formed separately from the cartridge frame to the cartridge frame in a case where a second process cartridge is assembled, which is mounted on a body of a second electrophotographic image-forming apparatus on which the second process cartridge is mounted in a direction different from that of the electrophotographic image-forming apparatus.

2. A method according to claim 1, wherein the handle member is attached at a position overlapping with at least part of the gripper portion in a direction intersecting with the axial direction of the electrophotographic photosensitive drum.

3. A method according to claim 1, wherein the handle member is attached to a mounting portion provided in the cartridge frame.

4. A method according to claim 2, wherein the handle member is attached to a mounting portion provided in the cartridge frame.

5. A process cartridge detachable from a main body of an electrophotographic image-forming apparatus, from a direction intersecting a mounting direction of a recording medium cassette mountable to the main body, the electrophotographic image-forming apparatus configured to form an image on the recording medium and including the recording medium cassette and an opening/closing member rotatable to open an upper portion of the electrophotographic image-forming apparatus, the process cartridge comprising:

an electrographic photosensitive drum;

a developing roller configured to develop a latent image, formed on the electrophotographic photosensitive drum, with toner;

a toner container adapted to contain the toner;

a concave recess defined on a surface of the toner container;

a handle member including a first gripping portion, the handle member detachably mounted on the concave recess such that the first gripping portion has a clearance from the concave recess extending in an axial direction of the electrophotographic photosensitive drum, the handle member detachably mounted on the concave recess such that a center of gravity of the process cartridge is positioned substantially below a vertical direction of the handle member as the first gripping portion is gripped by a user in attaching the process cartridge to the main body; and a second gripping portion provided downstream of the concave recess in the direction of attaching the process cartridge to the main body and extending in the axial direction of the electrophotographic photosensitive drum, the second gripping portion being provided in such a way that the center of gravity of the process cartridge is substantially below a vertical direction of the second gripping portion as the second gripping portion is being gripped by the user in attaching the process cartridge to the electrophotographic image-forming apparatus or a second electrophotographic image-forming apparatus different from the electrophotographic image-forming apparatus with the handle member being detached.

6. A process cartridge according to claim 5, wherein the handle member is detachably fixed to the concave recess with screws.

7. An electrophotographic image-forming apparatus operable to form an image on a recording medium and including a main body from which a process cartridge is detachable therefrom, the apparatus comprising:

(i) a cassette adapted to store the recording medium and mountable to the main body;

(ii) an opening/closing member rotatable to open an upper part of the main body;

(iii) a mounting portion configured to detachably mount the process cartridge from a direction intersecting a direction for mounting the cassette to the main body;

(iv) the process cartridge including:

an electrophotographic photosensitive drum;

a developing roller configured to develop a latent image, formed on the electrophotographic photosensitive drum, with toner;

a toner container adapted to contain the toner;

a concave recess defined on a surface of the toner container;

a handle member including a first gripping portion, the handle member detachably mounted on the concave recess such that the first gripping portion has a clearance from the concave recess extending in an axial direction of the electrophotographic photosensitive drum, the handle member detachably mounted on the concave recess such that a center of gravity of the process cartridge is positioned substantially below a vertical direction of the handle member as the first gripping portion is gripped by a user in attaching the process cartridge to the main body; and a second gripping portion provided downstream of the concave recess in the direction of attaching the process cartridge to the main body and extending in the axial direction of the electrophotographic photosensitive drum, the second gripping portion being provided in such a way that the center of gravity of the process cartridge is substantially below a vertical direction of the second gripping portion as the second gripping portion is being gripped by the user in attaching the process cartridge to the electrophotographic image-forming apparatus or a second electrophotographic image-forming apparatus different from the electrophotographic image-forming apparatus with the handle member being detached; and (v) a conveying unit conveying the recording medium.

* * * * *